US010072367B2

(12) United States Patent
Ueda

(10) Patent No.: US 10,072,367 B2
(45) Date of Patent: Sep. 11, 2018

(54) SEWING MACHINE

(71) Applicant: BROTHER KOGYO KABUSHIKI KAISHA, Nagoya-shi, Aichi-ken (JP)

(72) Inventor: Daisuke Ueda, Owariasahi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 10 days.

(21) Appl. No.: 15/377,430

(22) Filed: Dec. 13, 2016

(65) Prior Publication Data

US 2017/0088991 A1 Mar. 30, 2017

Related U.S. Application Data

(63) Continuation of application No. PCT/JP2015/084366, filed on Dec. 8, 2015.

(30) Foreign Application Priority Data

Dec. 25, 2014 (JP) ..... 2014-263212

(51) Int. Cl.
*D05B 55/16* (2006.01)
*D05B 65/06* (2006.01)

(52) U.S. Cl.
CPC ..... *D05B 55/16* (2013.01); *D05B 65/06* (2013.01)

(58) Field of Classification Search
CPC ..... D05B 55/14; D05B 55/16; D05B 65/06
See application file for complete search history.

(56) References Cited

U.S. PATENT DOCUMENTS 5,794,554 A * 8/1998 Akahane ..... D05B 19/12 112/220
6,874,437 B2 * 4/2005 Kim ..... D05C 5/02 112/102.5
7,252,044 B2 * 8/2007 Lee ..... D05B 19/105 112/102.5

(Continued)

FOREIGN PATENT DOCUMENTS

JP H05-23469 A 2/1993
JP 2004-222918 A 8/2004
JP 2007-301299 A 11/2007

OTHER PUBLICATIONS

Feb. 16, 2016 International Search Report issued in International Patent Application No. PCT/JP2015/084366.

(Continued)

*Primary Examiner* — Danny Worrell
(74) *Attorney, Agent, or Firm* — Oliff PLC

(57) ABSTRACT

A sewing machine includes a needle bar, a needle bar release mechanism, a drive portion, a contact member, and a switching mechanism. The needle bar is configured to move up and down. The needle bar release mechanism is configured to connect and disconnect the transmission of the driving force between the drive shaft and the needle bar. The drive portion is configured to drive the needle bar release mechanism. The contact member is configured to come into contact with the needle bar in a case where the needle bar is positioned at a top dead point of the range within which the needle bar is able to move up and down. The switching mechanism is configured to switch the position of the contact member between a first position and a second position.

8 Claims, 14 Drawing Sheets

(56) References Cited

U.S. PATENT DOCUMENTS

| | | | | |
|---|---|---|---|---|
| 7,966,956 | B2 * | 6/2011 | Suzuki | D05B 29/02<br>112/78 |
| 2007/0261621 | A1 | 11/2007 | Suzuki et al. | |

OTHER PUBLICATIONS

Jun. 27, 2017 International Preliminary Report on Patentability issued in International Patent Application No. PCT/JP2015/084366.

* cited by examiner

SEWING MACHINE

CROSS-REFERENCE TO RELATED APPLICATION

This application is a continuation application of International Application No. PCT/JP2015/084366, filed Dec. 8, 2015, which claims priority from Japanese Patent Application No. 2014-263212, filed on Dec. 25, 2014. The disclosure of the foregoing application is hereby incorporated by reference in its entirety.

BACKGROUND

The present disclosure relates to a sewing machine that is provided with a needle bar release mechanism.

A sewing machine is known that is provided with a needle bar release mechanism that is capable of decoupling the transmission of a driving force from a drive source to a needle bar. The needle bar of the sewing machine is released by the needle bar release mechanism from its connection to the drive source. The released needle bar is moved upward by the spring force of a compression spring that is externally fitted to the needle bar. At the top dead point of range within which the needle bar can move up and down, the needle bar comes into contact with a contact member and is locked.

SUMMARY

The needle bar comes into contact with the contact member at the top dead point even when the needle bar is connected to the drive source and moves reciprocally up and down. Even though the speed of the needle bar's up-down movement at the top dead point is zero, there is a possibility that when the needle bar comes into contact with the contact member, a small amount of noise and vibration will be generated.

Various embodiments of the broad principles derived herein provide a sewing machine in which the contact member that comes into contact with the needle bar when the needle bar has been released from its connection with the drive source does not come into contact with the needle bar when the needle bar is connected to the drive source and moving up and down.

Embodiments provide a sewing machine that includes a needle bar, a needle bar release mechanism, a drive portion, a contact member, and a switching mechanism. The needle bar is configured to move up and down. A driving force of a sewing machine motor is transmitted through a drive shaft to the needle bar. The needle bar release mechanism is configured to connect and disconnect a transmission of the driving force between the drive shaft and the needle bar. The drive portion is configured to drive the needle bar release mechanism. The contact member is configured to come into contact with the needle bar in a case where the needle bar is positioned at a top dead point of the range within which the needle bar is able to move up and down. The switching mechanism is configured to switch a position of the contact member between a first position and a second position. The first position is a position in which the contact member does not come into contact with the needle bar in a case where the needle bar is positioned at the top dead point. The second position is a position in which the contact member does come into contact with the needle bar in a case where the needle bar is positioned at the top dead point. The switching mechanism positions the contact member in the first position when the sewing machine is in a connected state. The connected state is a state in which the transmission of the driving force between the drive shaft and the needle bar is connected. The switching mechanism positions the contact member in the second position when the sewing machine is in a connection transition state. The connection transition state is a state in which the sewing machine is in transition from a disconnected state to the connected state. The disconnected state is a state in which the transmission of the driving force between the drive shaft and the needle bar is disconnected.

Embodiments provide a sewing machine that includes a motor, a needle bar, a needle bar release mechanism, and a contact member. The contact member is configured to move between a first position and a second position. The first position is a position in which the contact member does not come into contact with the needle bar in a case where the needle bar is positioned at a top dead point of a range within which the needle bar is able to move up and down when the sewing machine is in a connected state. The connected state is a state in which the needle bar release mechanism connects the transmission of a driving force of the motor to the needle bar. The second position is a position in which the contact member does come into contact with the needle bar in a case where the needle bar is positioned at the top dead point when the sewing machine is in a connection transition state. The connection transition state is a state in which the sewing machine is in transition from a disconnected state to the connected state. The disconnected state is a state in which the needle bar release mechanism disconnects the transmission of the driving force of the motor to the needle bar.

BRIEF DESCRIPTION OF THE DRAWINGS

Embodiments will be described below in detail with reference to the accompanying drawings in which.

DETAILED DESCRIPTION

Hereinafter, an embodiment will be explained with reference to the drawings. First, the configuration of a sewing machine 1 will be explained. In the explanation that follows, the top side, the bottom side, the lower left side, the upper right side, the upper left side, and the lower right side in FIG. 1 respectively define the top side, the bottom side, the front side, the rear side, the left side, and the right side of the sewing machine 1.

Figure 1:
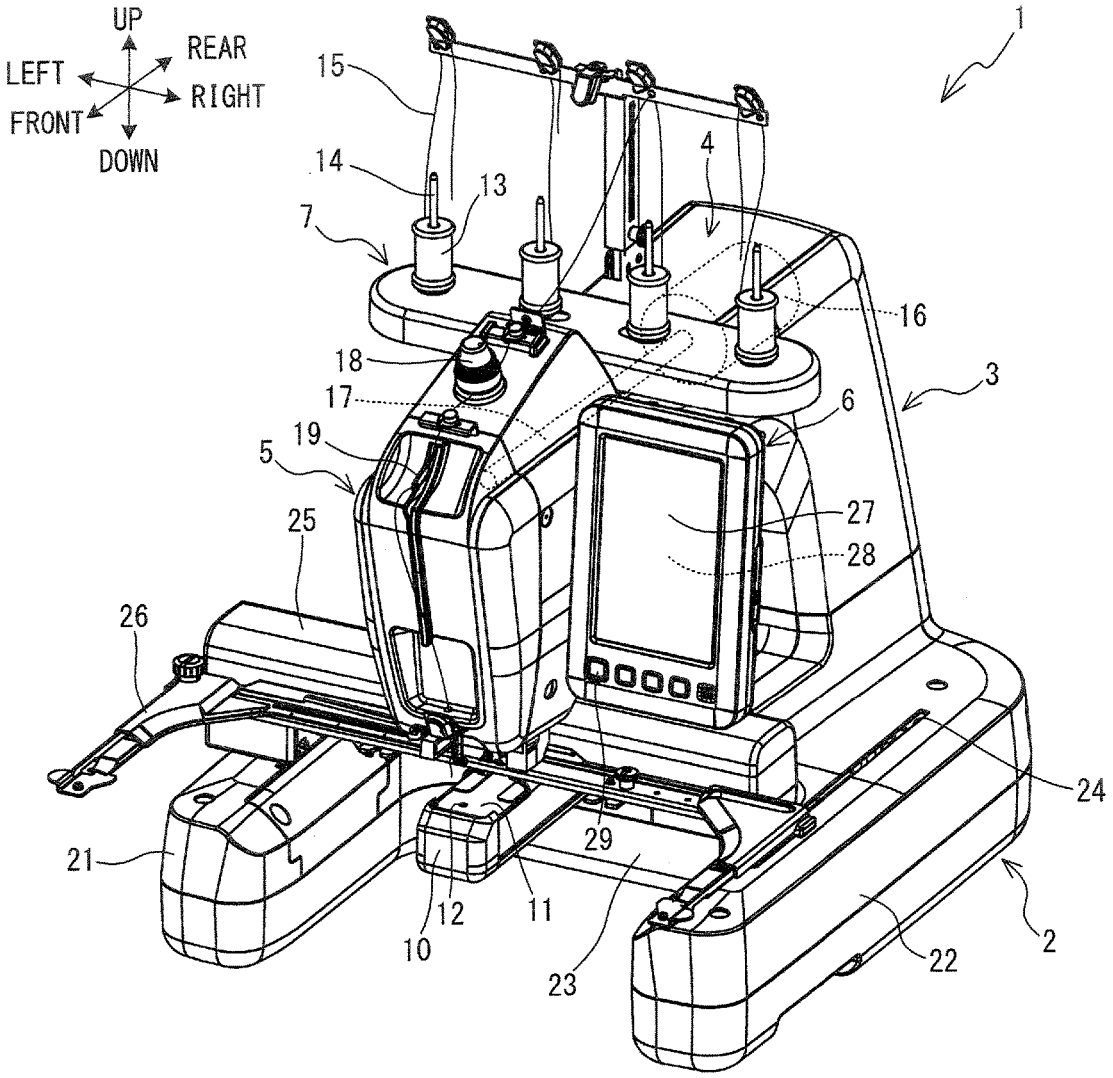
FIG. 1 is an oblique view of a sewing machine.

As shown in FIG. 1, the sewing machine 1 is mainly includes a support portion 2, a pillar 3, and an arm 4. The support portion 2 is the base portion of the sewing machine 1 and supports the entire sewing machine 1. The pillar 3 is provided in the rear part of the support portion 2 and extends upward. The arm 4 extends toward the front from the upper end of the pillar 3 such that the arm 4 is opposite a cylinder head 10 (described later). The front end of the arm 4 is a head 5.

The support portion 2 is formed such that, as a whole, the support portion 2 is substantially U-shaped in a plan view. The support portion 2 includes a pair of legs 21, 22 and a base portion 23. The pair of the legs 21, 22 each extend in the front-rear direction, and the pair of the legs 21, 22 are respectively provided on the left and right sides of the support portion 2. The base portion 23 is disposed between the rear portions of the leg 21 and the leg 22. The base portion 23 extends in the left-right direction and connects the leg 21 and the leg 22.

A lower shaft (not shown in the drawings) is provided inside the base portion 23. The lower shaft is rotationally driven by a drive shaft 17, which will be described later. Approximately in the center in the left-right direction, the base portion 23 is provided with the cylinder head 10, which is tube-shaped and extends toward the front. The top face of the cylinder head 10 is a face on which a work cloth (not shown in the drawings) is disposed. A shuttle mechanism (not shown in the drawings) is provided in the interior of the cylinder head 10. The driving force of a sewing machine motor 16, which will be described later, is transmitted to the shuttle mechanism through the lower shaft. The shuttle mechanism rotationally drives a shuttle (not shown in the drawings) that is disposed in the interior of the front end of the cylinder head 10. The shuttle accommodates a bobbin (not shown in the drawings), around which a lower thread (not shown in the drawings) is wound. A needle plate 11, which is rectangular in a plan view, is provided on the top face of the front end of the cylinder head 10. The needle plate 11 is disposed above the shuttle. A needle hole 12 is formed in the needle plate 11. A sewing needle 9, which is mounted on a lower end of the needle bar 30 (refer to FIG. 2) that will be described later, is inserted into the needle hole 12 of the needle plate 11.

A guide groove 24 that extends in the front-rear direction is formed in each one of the top faces of the legs 21, 22. The pair of the guide grooves 24 guide the movement of a carriage 25 in the front-rear direction. The carriage 25 extends in the left-right direction and spans the distance between the pair of the legs 21, 22. A movement mechanism (not shown in the drawings) is provided in the carriage 25. The movement mechanism moves a holder 26, which is disposed on the front side of the carriage 25, to the left and the right. An embroidery frame (not shown in the drawings), which holds the work cloth, is mounted on the holder 26. The sewing machine 1 uses the movement of the carriage 25 in the front-rear direction (that is, the movement of the entire movement mechanism in the front-rear direction) and the moving of the holder 26 by the movement mechanism to move the embroidery frame that is mounted on the holder 26 in the front-rear direction and the left-right direction.

The sewing machine motor 16, a control portion (not shown in the drawings) of the sewing machine 1, and the like are provided in the interior of the pillar 3. The sewing machine motor 16 rotationally drives the drive shaft 17, which is provided inside the arm 4. The drive shaft 17 and the lower shaft inside the support portion 2 are coupled by a timing belt (not shown in the drawings). The rotation of the drive shaft 17 is transmitted to the lower shaft, such that the drive shaft 17 and the lower shaft rotate in synchronization.

The drive shaft 17 is provided in the interior of the arm 4 and extends in the front-rear direction. The drive shaft 17 drives a thread take-up mechanism 20, which is provided in the interior of the head 5, a needle bar drive mechanism 40 (described later), and the like. A thread spool base 7 is provided on the top face of the arm 4. The thread spool base 7 is provided with a plurality (for example, four) of thread spool pins 14. Each one of the thread spool pins 14 is inserted into an insertion hole in one of a plurality (for example, four) of thread spools 13, around each of which an upper thread 15 is wound. The plurality of the thread spools 13 can be mounted on the thread spool base 7.

A tensioner 18 is provided on the top of the head 5. The tensioner 18 imparts tension to the upper thread 15 that is supplied from the thread spool base 7. The internal configuration of the head 5 will be described later. An operation portion 6 is provided on the right side of the head 5. The operation portion 6 includes a liquid crystal display 61, a touch panel 62, a start/stop switch 63, and the like. Various types of information are displayed on the liquid crystal display 61, such as an operation screen for a user to input commands, for example. The touch panel 62 accepts commands from the user. The start/stop switch 63 is a switch for issuing commands to start and stop sewing.

Figure 2:
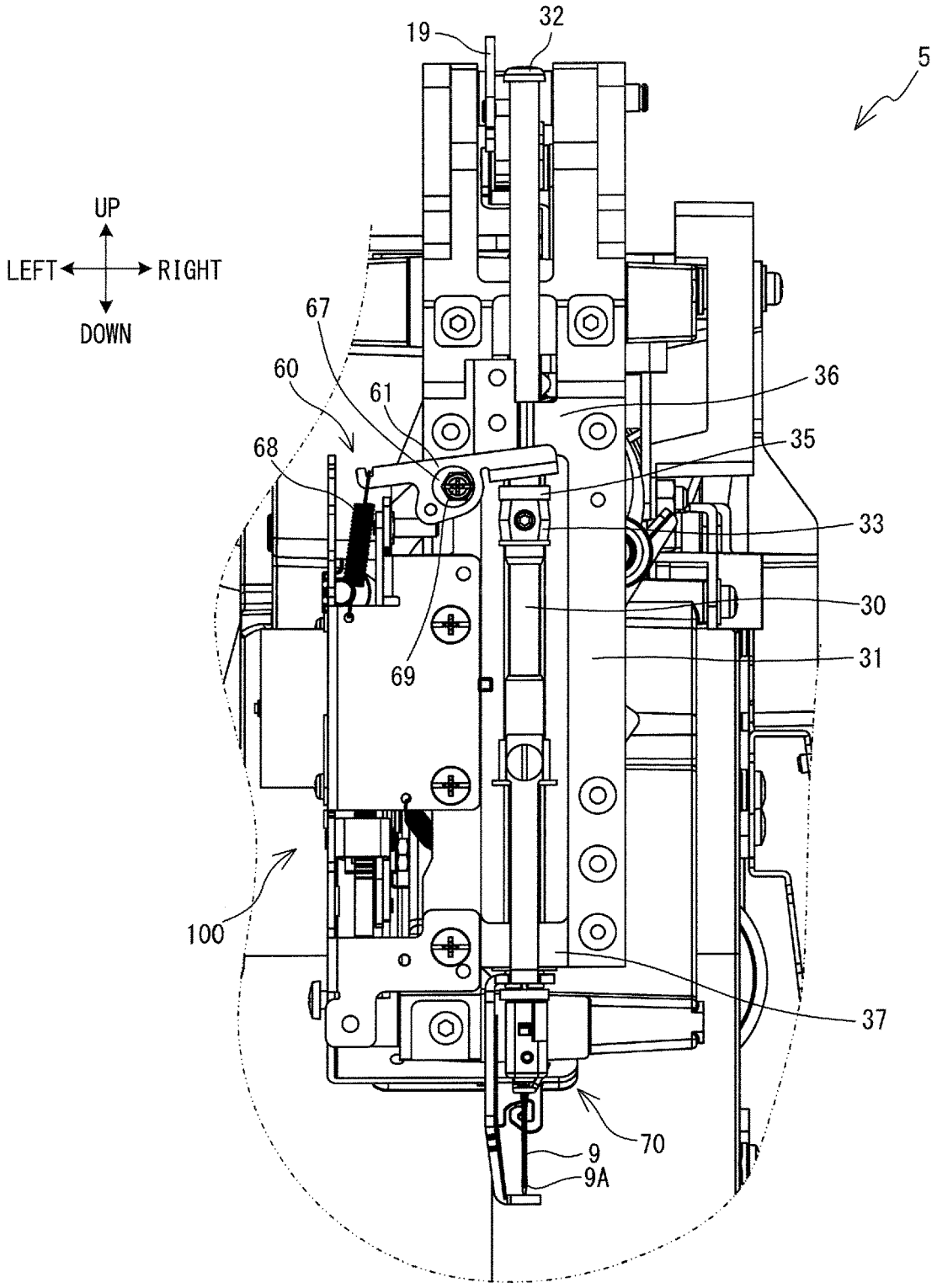
FIG. 2 is a figure that shows a portion of the configuration of the interior of a head, as seen from the front of the sewing machine.
Figure 3:
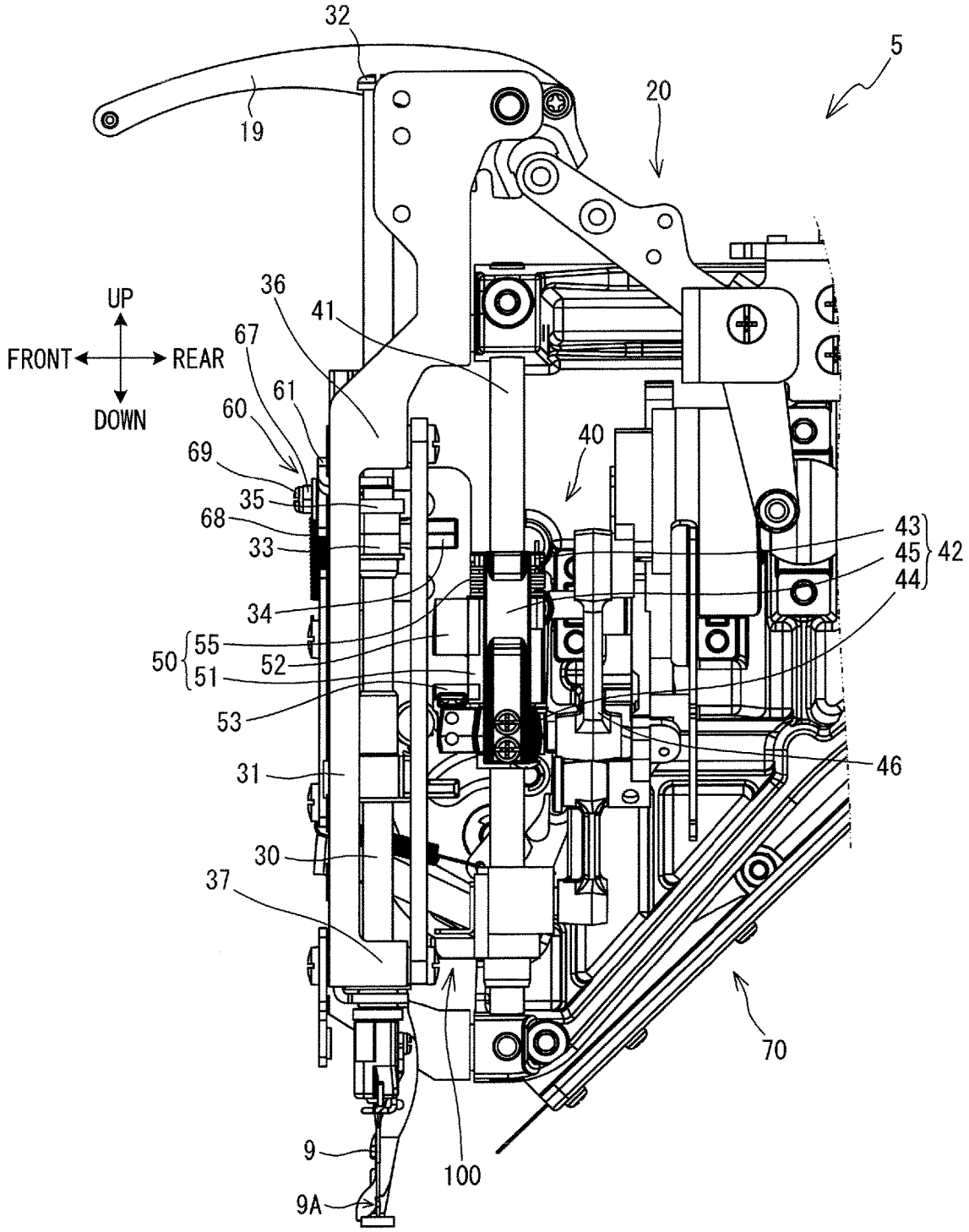
FIG. 3 is a figure that shows a portion of the configuration of the interior of the head, as seen from the right side of the sewing machine.

Next, the internal configuration of the head 5 will be described with reference to FIGS. 2 to 9. As shown in FIGS. 2 and 3, the needle bar 30, the thread take-up mechanism 20, the needle bar drive mechanism 40, a needle bar release mechanism 50, a switching mechanism 60, a thread wiper mechanism 70, a drive unit 100, and the like are provided in the interior of the head 5.

The needle bar 30 extends in the up-down direction inside the head 5 (refer to FIG. 1). The needle bar 30 is supported by a needle bar frame 31 such that the needle bar 30 is able to move up and down. Specifically, the needle bar frame 31 is provided with an upper support portion 36 and a lower support portion 37 that support the needle bar 30, and the needle bar 30 is supported by the two support portions such that the needle bar 30 is able to move up and down. The needle bar frame 31 is affixed to a machine casing (not shown in the drawings) of the sewing machine 1 inside the head 5. A coupling member 33 is affixed to a middle portion in the up-down direction of the needle bar 30 (between the upper support portion 36 and the lower support portion 37). The coupling member 33 is provided with a coupling pin 34, which projects radially outward toward the rear. The coupling member 33 couples to a transmission member 51 (described later) of the needle bar release mechanism 50 and transmits the driving force of the sewing machine motor 16 to the needle bar 30.

A ring-shaped spacer 35, which is made of rubber, for example, is affixed to the upper end of the coupling member 33. In a case where a contact member 61 of the switching mechanism 60, which will be described later, is positioned in a second position (described later) and the needle bar 30 is positioned at the top dead point of the range within which the needle bar 30 can move up and down, the spacer 35 comes into contact with the contact member 61. A screw 32 is tightened into the upper end of the needle bar 30. The outside diameter of the head of the screw 32 is greater than the outside diameter of the needle bar 30. Although not shown in the drawings, a compression spring is externally fitted to the outer circumferential face of the needle bar 30, in the area between the upper support portion 36 and the head of the screw 32. The compression spring presses the head of the screw 32 upward, so the compression spring energizes the needle bar 30 upward. In a case where the coupling member 33 and the transmission member 51 are not coupled, the needle bar 30 is moved upward by the energizing force of the compression spring and is positioned at the top dead point.

The lower end of the needle bar 30 extends downward from the lower edge of the head 5. The sewing needle 9 can be mounted on the lower end of the needle bar 30. An eye 9A, through which the upper thread 15 can be passed, is formed in the sewing needle 9.

The thread take-up mechanism 20 is connected to the drive shaft 17 (refer to FIG. 1) inside the arm 4. The driving force of the sewing machine motor 16 is transmitted to the thread take-up mechanism 20 through the drive shaft 17. The thread take-up mechanism 20 moves a thread take-up lever 19 up and down in coordination with the up-down movement of the needle bar 30. During sewing, the needle bar 30 operates in coordination with the shuttle to entwine the upper thread 15 that passes through the eye 9A of the sewing needle 9 with the lower thread, which is pulled out from the bobbin that is housed in the shuttle. The thread take-up lever 19 pulls the upper thread 15, now entwined with the lower thread, upward above the needle plate 11.

Figure 4:
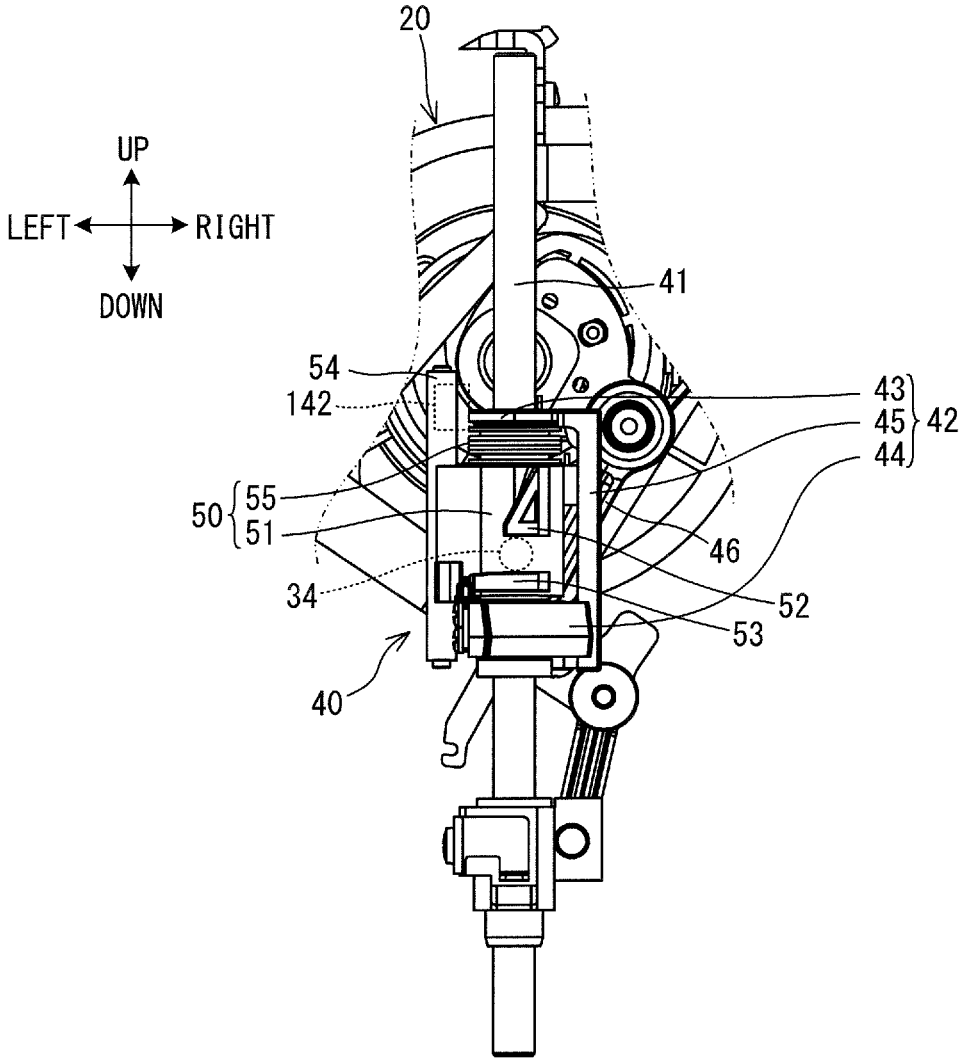
FIG. 4 is a front view of a needle bar drive mechanism and a needle bar release mechanism.

The needle bar drive mechanism 40 is a mechanism that drives the needle bar 30 up and down by taking the driving force of the sewing machine motor 16 that is transmitted through the drive shaft 17 and converting the driving force from rotary movement to up-down movement. As shown in FIGS. 3 and 4, the needle bar drive mechanism 40 includes a needle bar base 41, a drive member 42, and a crank rod 46. The needle bar base 41 is a cylindrical bar that extends in the up-down direction. The needle bar base 41 is provided to the rear of the needle bar 30 and is disposed parallel to the needle bar 30. The drive member 42 is externally fitted to the needle bar base 41 and is provided such that the drive member 42 can move up and down in relation to the needle bar base 41, but not rotate. The drive member 42 includes an upper end portion 43, a lower end portion 44, and a middle portion 45. The upper end portion 43 and the lower end portion 44 are each externally fitted to the needle bar base 41 and are disposed such that there is a gap between the upper end portion 43 and the lower end portion 44 in the up-down direction. The middle portion 45 is provided such that the middle portion 45 does not touch the needle bar base 41. But the middle portion 45 is connected to the upper end portion 43 and the lower end portion 44. The needle bar release mechanism 50 (described later) is provided between the upper end portion 43 and the lower end portion 44 of the drive member 42. The needle bar release mechanism 50 connects and disconnects the transmission of the driving force to the needle bar 30.

The crank rod 46 couples the lower end portion 44 of the drive member 42 to a needle bar crank (not shown in the drawings). The needle bar crank is affixed to the front end of an upper shaft and rotates as a single unit with the drive shaft 17. The rotation of the drive shaft 17 and the needle bar crank causes the drive member 42 to move reciprocally up and down along the needle bar base 41. In a state in which the needle bar release mechanism 50 connects the transmission of the driving force to the needle bar 30, the driving force of the sewing machine motor 16 that is transmitted to the needle bar drive mechanism 40 through the drive shaft 17 is transmitted to the needle bar 30. In this case, the needle bar release mechanism 50 and the needle bar 30 are coupled to the drive member 42, which moves reciprocally up and down along the needle bar base 41, so the needle bar release mechanism 50 and the needle bar 30 also move reciprocally up and down.

Figure 5:
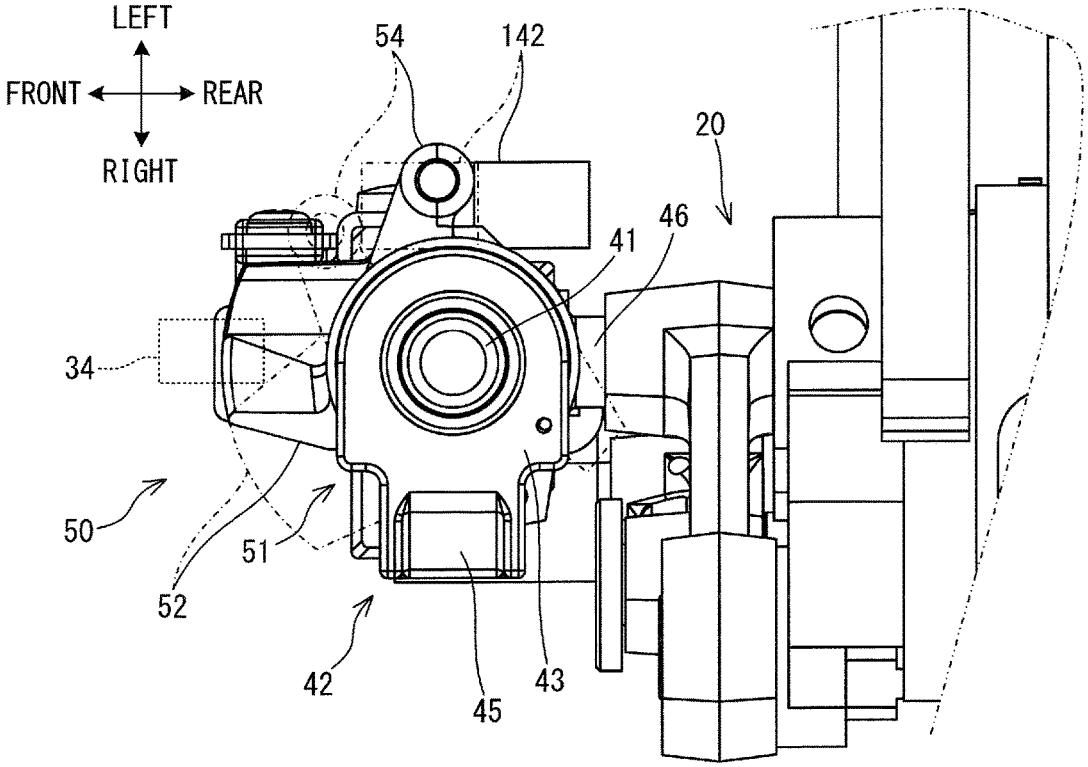
FIG. 5 is a plan view of the needle bar drive mechanism and the needle bar release mechanism.

As shown in FIGS. 3 to 5, the needle bar release mechanism 50 is a mechanism that connects and disconnects the transmission of the driving force of the sewing machine motor 16 from the needle bar drive mechanism 40 to the needle bar 30. The needle bar release mechanism 50 includes the transmission member 51 and a coil spring 55. The transmission member 51 is externally fitted to the needle bar base 41 and is provided such that the transmission member 51 can move up and down and rotate in relation to the outer circumferential face of the needle bar base 41. An upper engagement lug 52, a lower engagement lug 53, and a contact post 54 (refer to FIG. 4) are provided on the transmission member 51. The upper engagement lug 52 and the lower engagement lug 53 project radially outward from the outer circumferential face of the transmission member 51, with a gap between the upper engagement lug 52 and the lower engagement lug 53 in the up-down direction. The upper engagement lug 52 is formed such that the top face of the upper engagement lug 52 is an inclined plane that slopes downward to the left (refer to FIG. 4). The coupling pin 34 of the needle bar 30 engages with the upper engagement lug 52 and the lower engagement lug 53. The contact post 54 is a component that is formed in a rod shape that extends in the up-down direction. The contact post 54 is provided in a location where the contact post 54 projects radially outward from the outer circumferential face of the transmission member 51. A first pin 142 (described later) of the drive unit 100 comes into contact with the contact post 54 from the rear side. In a case where the contact post 54 is pressed toward the front by the first pin 142 (shown by broken lines in FIG. 5), the transmission member 51 rotates counterclockwise in a plan view (refer to FIG. 5). The upper engagement lug 52 and the lower engagement lug 53 of the transmission member 51 move to positions that are in front of and obliquely to the right of the needle bar base 41. In this case, the engagement of the coupling pin 34 of the needle bar 30 with the upper engagement lug 52 and the lower engagement lug 53 is released. When the transmission of the driving force from the needle bar drive mechanism 40 to the needle bar 30 is disconnected, the needle bar 30 is moved upward by the energizing force of the compression spring and is positioned at the top dead point (refer to FIG. 3).

The coil spring 55 is connected to the upper portion of the transmission member 51. The coil spring 55 is externally fitted to the upper end portion 43 of the drive member 42. In a plan view, the coil spring 55 energizes the transmission member 51 in the clockwise direction in relation to the drive member 42. In a case where the contact post 54 of the transmission member 51 is not being pressed by the first pin 142 of the drive unit 100, the transmission member 51 is rotated by the coil spring 55. The upper engagement lug 52 and the lower engagement lug 53 move to positions that are directly in front of the needle bar base 41. In other words, the upper engagement lug 52 and the lower engagement lug 53 move to positions where the upper engagement lug 52 and the lower engagement lug 53 can engage with the coupling pin 34 of the needle bar 30.

Figure 6:
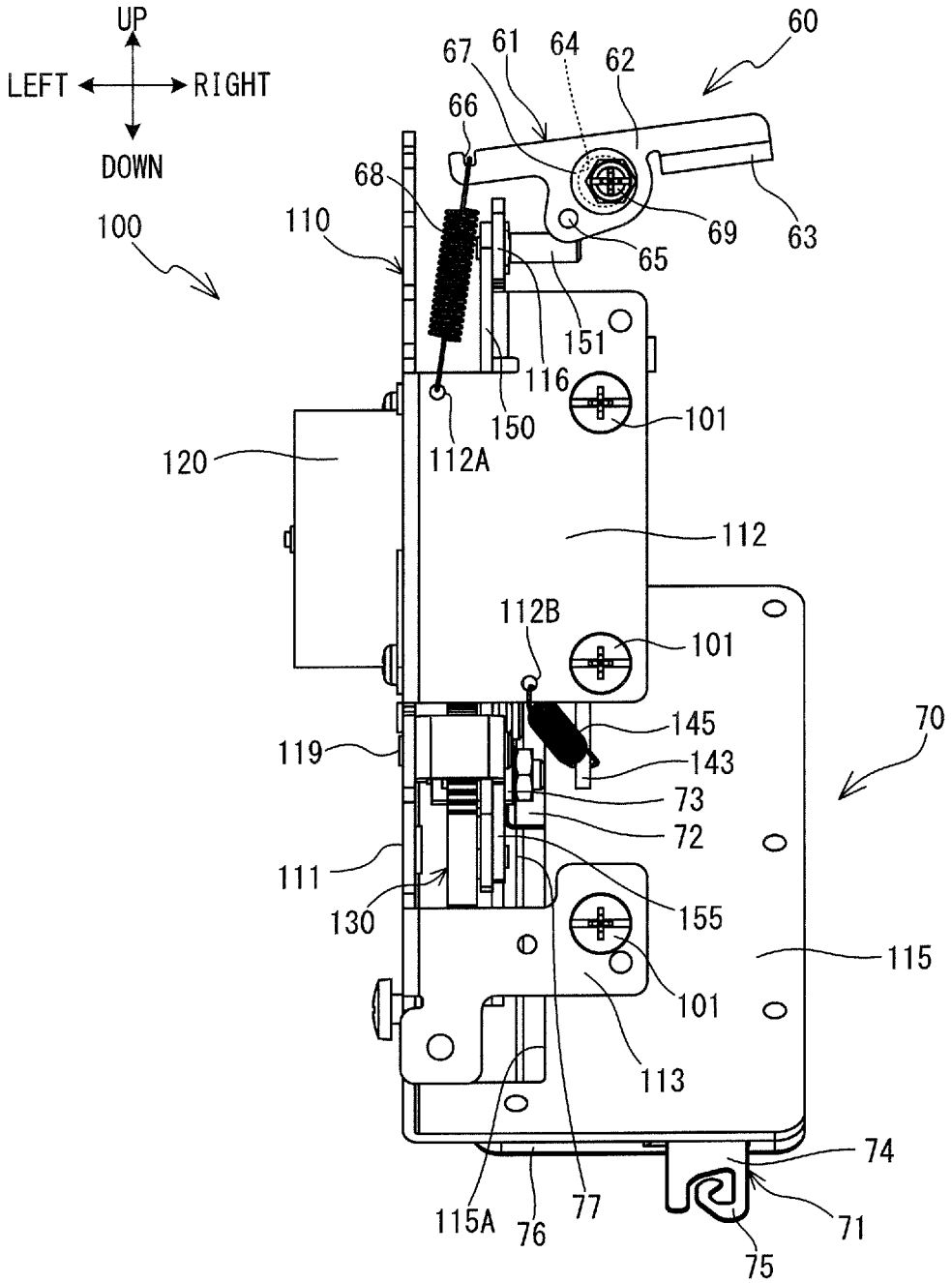
FIG. 6 is a front view of a switching mechanism, a thread wiper mechanism, and a drive unit.
Figure 7:
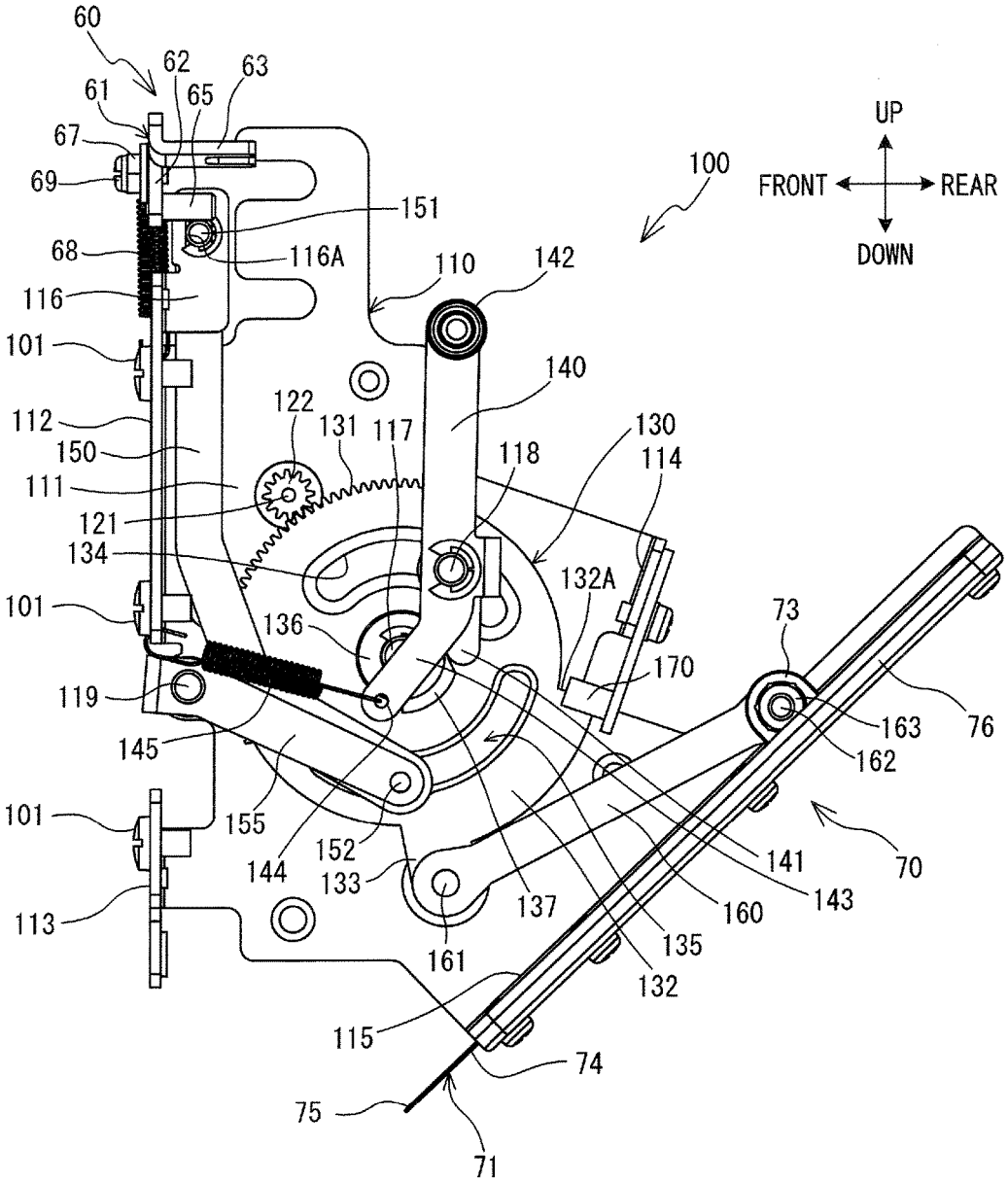
FIG. 7 is a right side view of the switching mechanism, the thread wiper mechanism, and the drive unit.
Figure 8:
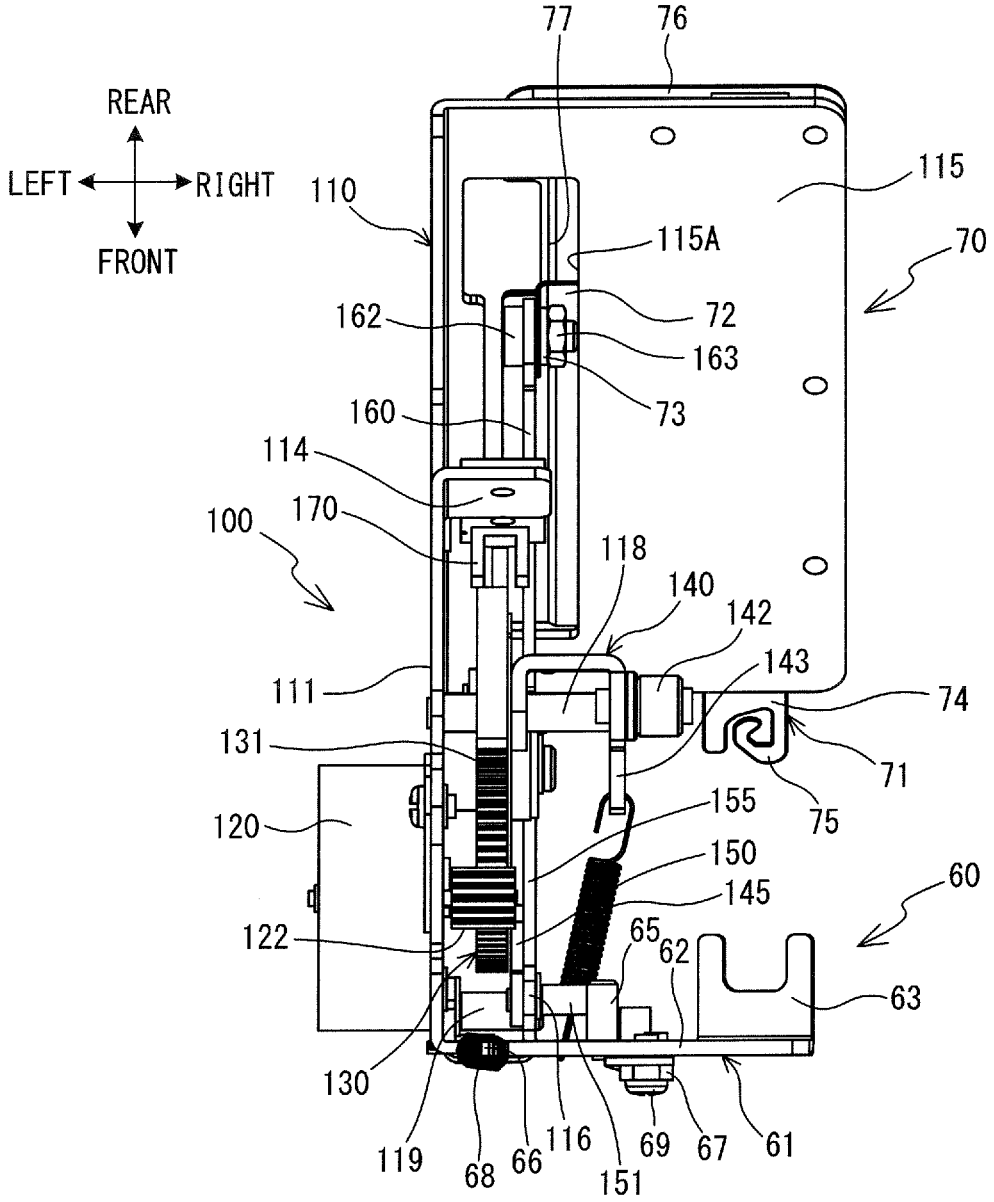
FIG. 8 is a plan view of the switching mechanism, the thread wiper mechanism, and the drive unit.

The switching mechanism 60 is a mechanism that switches the position of the contact member 61 between a first position and the second position. As shown in FIGS. 6 to 8, the switching mechanism 60 is disposed on top of the front side of the drive unit 100, which will be described later. The switching mechanism 60 includes the contact member 61 and a tension spring 68. The contact member 61 is a member that positions the needle bar 30 in a case where the needle bar 30 is at the top dead point of the range within which the needle bar 30 can move up and down. The contact member 61 includes a body portion 62, a contact portion 63, a support hole 64, an operation pin 65, and a suspension portion 66. The body portion 62 is a plate-shaped body that is disposed such that the long dimension of the body portion 62 extends in the left-right direction and the thickness of the body portion 62 extends in the front-rear direction. The support hole 64 is formed approximately in the center in the left-right direction of the body portion 62, and is a through-hole from the front to the rear side of the body portion 62.

An eccentric nut 67 is inserted through the support hole 64. The eccentric nut 67 is affixed to the needle bar frame 31 by a screw 69 (refer to FIG. 2). The contact portion 63 is provided on the right end portion of the body portion 62. The contact portion 63 projects toward the rear from the lower edge of the right end portion of the body portion 62. The contact portion 63 is formed to be U-shaped in a plan view. The contact portion 63 comes into contact with the spacer 35 of the coupling member 33 in a case where the contact member 61 is positioned in the second position and the needle bar 30 is positioned at the top dead point. The notch-shaped suspension portion 66 is formed in the left end portion of the body portion 62. One end of the tension spring 68 is fastened to the suspension portion 66. The other end of the tension spring 68 is fastened to a fastening hole 112A (refer to FIG. 6) in a gear frame 110 of the drive unit 100. The contact member 61 is positioned in the first position, in which the contact portion 63 is energized upward by the tension spring 68, with the eccentric nut 67 that is inserted through the support hole 64 serving as a pivot point. In a case where the contact member 61 is in the first position, the contact portion 63 does not come into contact with the spacer 35 of the coupling member 33, even if the needle bar 30 is at the top dead point.

The operation pin 65, which projects toward the rear, is provided below and to the left of the support hole 64. A second pin 151 (described later) of the drive unit 100 comes into contact with the operation pin 65. In a case where the operation pin 65 is pressed upward by the second pin 151, the contact member 61 is positioned in the second position (refer to FIG. 12), where the contact member 61 has moved the contact portion 63 downward, with the eccentric nut 67 serving as a pivot point. In a case where the contact member 61 is positioned in the second position, then if the needle bar 30 is positioned at the top dead point, the contact portion 63 comes into contact with the spacer 35 of the coupling member 33.

Figure 9:
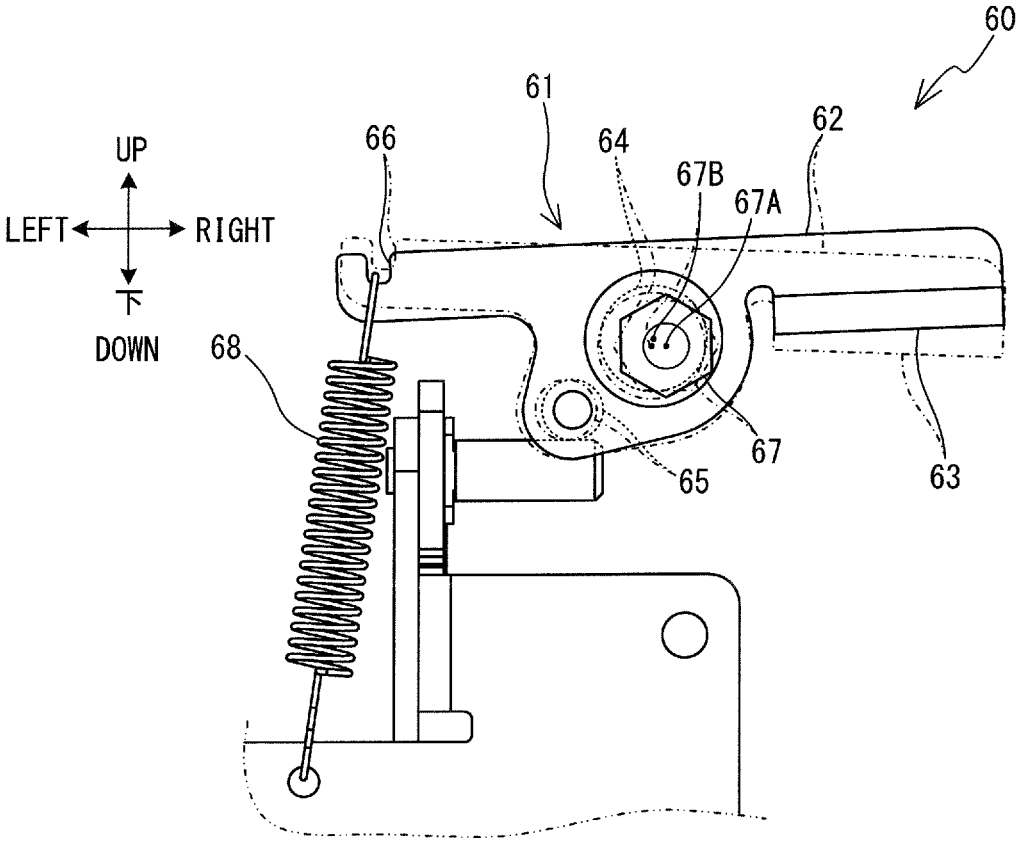
FIG. 9 is a front view of the switching mechanism.

As shown in FIG. 9, the eccentric nut 67 is formed such that the position of a shaft center 67A and the position of a shaft center 67B do not coincide (are offset from one another). The shaft center 67A is at the center of a hole into which the screw 69 that affixes the eccentric nut 67 to the needle bar frame 31 is fitted. The shaft center 67B is at the center of a boss that engages with the support hole 64 and serves as the center of rotation of the contact member 61. To facilitate the explanation, the screw 69 that affixes the eccentric nut 67 to the needle bar frame 31 is not shown in FIG. 9. The position of the shaft center 67A of the eccentric nut 67 is fixed with respect to the needle bar frame 31. In contrast, the position of the shaft center 67B, as shown by a broken line in FIG. 9, shifts in a circumferential path around the shaft center 67A in accordance with the angle at which the eccentric nut 67 is affixed to the needle bar frame 31. In other words, the position of the center of rotation of the contact member 61 can be shifted by loosening the screw 69 and changing the angle at which the eccentric nut 67 is affixed to the needle bar frame 31. Shifting the position of the center of rotation of the contact member 61 shifts the position of the contact portion 63 one of upward and downward. Therefore, the eccentric nut 67 is able to adjust the position in the up-down direction at which the contact portion 63 comes into contact with the spacer 35 of the coupling member 33 when the contact member 61 is positioned in the second position and the needle bar 30 is positioned at the top dead point.

As shown in FIGS. 6 to 8, the thread wiper mechanism 70 is a mechanism that, when the sewing is finished or a thread is changed, wipes away, from below the sewing needle 9, the end portion of the upper thread 15 that has been passed through the eye 9A of the sewing needle 9, so that the upper thread 15 does not become entangled in the stitching. The thread wiper mechanism 70 is attached to the lower rear portion of the drive unit 100, which will be described later, and is provided in the lower part of the interior of the head 5. The thread wiper mechanism 70 includes with a thread wiper member 71 and a guide member 76. The thread wiper member 71 is a plate-shaped member that extends obliquely from the upper rear toward the lower front. The thread wiper member 71 includes a base portion 72, a support portion 73, and an arm portion 74, and a hook 75. The base portion 72 engages with a groove portion 77 that is formed in the guide member 76. The support portion 73, which projects upward from the base portion 72, is formed in the rear portion of the left side of the base portion 72. The support portion 73 includes a hole (not shown in the drawings) that extends through it in the left-right direction, and a shoulder screw 162 (described later) that engages with a connecting rod 160 of the drive unit 100 is inserted through the hole. The driving force that is transmitted from the drive unit 100 moves the base portion 72, which is guided by the groove portion 77, between an upper rear position and a lower front position.

The arm portion 74 projects obliquely downward toward the front from the front end of the base portion 72. The arm portion 74 is formed such that the arm portion 74 is narrower than the base portion 72 in the left-right direction and is longer than the base portion 72. The hook 75 is formed on the front end of the arm portion 74. In a case where the thread wiper member 71 has moved obliquely downward toward the front, the hook 75 is positioned below the sewing needle 9 (refer to FIG. 3). Using the hook 75, the thread wiper member 71 is able to catch and hold the upper thread 15, which is hanging down from the eye 9A of the sewing needle 9.

The guide member 76 has a rectangular plate shape, and the guide member 76 is attached to the bottom face of a thread wiper anchoring portion 115 of the gear frame 110 (described later) of the drive unit 100. The guide member 76 causes the base portion 72 of the thread wiper member 71 to engage with the groove portion 77, and the guide member 76 holds the base portion 72 up against the thread wiper anchoring portion 115. An opening 115A (refer to FIG. 8) is formed in the top face of the thread wiper anchoring portion 115. The support portion 73 of the thread wiper member 71 is exposed toward the top of the thread wiper anchoring portion 115 through the opening 115A.

Next, the drive unit 100 will be explained. The drive unit 100 is a unit that drives the needle bar release mechanism 50, the switching mechanism 60, and the thread wiper mechanism 70 using the driving force of a single drive source. The drive unit 100 includes the gear frame 110, a pulse motor 120, a sector gear 130, a first link rod 140, a second link rod 150, the connecting rod 160, and a photo-sensor 170.

The gear frame 110 is a frame that is formed by bending a metal plate and that supports various parts that make up the drive unit 100. The gear frame 110 includes a body portion 111, front face frames 112, 113, a sensor anchoring portion 114, and the thread wiper anchoring portion 115. The body portion 111 is disposed inside the head 5 such that the thickness of the body portion 111 extends in the left-right direction (refer to FIG. 2). The body portion 111 extends in the up-down direction, and the lower portion of the body portion 111 is formed such that the lower portion of the body portion 111 is wider in the front-rear direction. The sector gear 130 is disposed on the right side face (called the front face for convenience) of the body portion 111, and the pulse motor 120 is disposed on the left side face (called the rear face for convenience) of the body portion 111. A support shaft 117 (refer to FIG. 7) that supports the sector gear 130 such that the sector gear 130 can rotate is affixed to the body portion 111 approximately in center of the up-down direction and projects to the right from the body portion 111. A hole (not shown in the drawings) through which an output shaft 121 of the pulse motor 120 is inserted is formed in the body portion 111 obliquely above and toward the front from the support shaft 117. A support shaft 118 (refer to FIG. 7) is affixed to the body portion 111 obliquely above and toward the rear from the support shaft 117. The support shaft 118 projects to the right from the body portion 111. The support shaft 118 supports the first link rod 140 such that the first link rod 140 can pivot. A support shaft 119 that supports the front end portion of a support rod 155 (described later) such that the support rod 155 can pivot is affixed to the body portion 111 toward the front from the support shaft 117, projecting to the right from the body portion 111.

The front face frames 112, 113 are formed on the front side of the body portion 111 by bending two vertically separated parts of the front face such that the front face faces toward the rear. Threaded holes (not shown in the drawings) are formed in two locations in the upper front face frame 112 and in one location in the lower front face frame 113. An anchoring screw 101 is inserted through each one of the threaded holes and tightened to the needle bar frame 31. The front face frames 112, 113 anchor the gear frame 110 to the needle bar frame 31. A pin guide portion 116 is formed by bending, toward the rear, a portion of the metal plate on the upper left side of the front face frame 112. A vertically oblong support hole 116A (refer to FIG. 7) is formed in the pin guide portion 116, extending through the pin guide portion 116 in the left-right direction. The second pin 151, which is affixed to the upper end of the second link rod 150, is inserted through the support hole 116A. The support hole 116A supports the second pin 151 such that the second pin 151 can move up and down. The fastening hole 112A (refer to FIG. 6) is also formed in the upper portion of the front face frame 112. As explained previously, the switching mechanism 60 is disposed on top of the front side of the drive unit 100. The position where the switching mechanism 60 is disposed is above the front face frame 112. The other end of the tension spring 68 of the switching mechanism 60 is fastened to the fastening hole 112A. As explained previously, the contact portion 63 of the contact member 61 is energized upward by the tension spring 68, with the eccentric nut 67 serving as a pivot point.

The sensor anchoring portion 114 is formed in a portion of the rear side of the body portion 111 by bending the front face such that the front face faces obliquely upward toward the front. The sensor anchoring portion 114 is provided toward the rear from the support shaft 117. The photo-sensor 170 is affixed to the sensor anchoring portion 114.

The thread wiper anchoring portion 115 is formed on the lower side of the body portion 111 by bending the front face such that the front face faces obliquely upward toward the front. The opening 115A, which is formed in the top face of the thread wiper anchoring portion 115, extends in the front-rear direction. As explained previously, the guide member 76 of the thread wiper mechanism 70 is attached to the bottom face of the thread wiper anchoring portion 115.

The pulse motor 120 is affixed to the rear face of the body portion 111. The output shaft 121 of the pulse motor 120 extends in the left-right direction, and the right end portion of the output shaft 121 protrudes from the front face of the body portion 111. A drive gear 122 is affixed to the right end portion of the output shaft 121. The gear teeth of the drive gear 122 mesh with gear teeth 131 of the sector gear 130. The pulse motor 120 operates in accordance with a command from the control portion of the sewing machine 1 and rotates sector gear 130.

As shown in FIG. 7, the sector gear 130 is a substantially disc-shaped rotating body, with the gear teeth 131 formed on a portion of the outer circumference of the sector gear 130. The sector gear 130 is disposed on the front face of the body portion 111 and is rotatably supported by the support shaft 117 that is provided in the body portion 111. As described above, the drive gear 122 that is provided on the output shaft 121 of the pulse motor 120 meshes with the gear teeth 131. The pulse motor 120 rotates the sector gear 130 through the range in which the gear teeth 131 are formed. A detection portion 132, a projecting portion 133, a guide hole 134, a grooved cam 135, and a disc cam 136 are provided in the sector gear 130.

The detection portion 132 is an outer circumferential portion of the sector gear 130 and is provided on the opposite side from the gear teeth 131. The detection portion 132 projects radially outward over a portion of the circumference of the sector gear 130. The detection portion 132 is used for the photo sensor 170 to detect an origin point position in the rotation of the sector gear 130. The photo-sensor 170 is a photo-interrupter that is provided with a light-receiving element and a light-emitting element. When the photo-sensor 170 detects that an edge 132A in the circumferential direction of the detection portion 132 has passed between the light-receiving element and the light-emitting element, the control portion (not shown in the drawings) of the sewing machine 1 determines that the rotational position of the sector gear 130 is at the origin point position. When the sector gear 130 is in the origin point position, the gear teeth 131 are disposed at a position on the outer circumference of the sector gear 130 where the gear teeth 131 extend from above the support shaft 117 to in front of the support shaft 117.

The projecting portion 133 projects radially outward from the outer circumference of the sector gear 130 at a point that is at the bottom of the sector gear 130 when the sector gear 130 is in the origin point position. A hole (not shown in the drawings) is provided in the projecting portion 133 that extends through the projecting portion 133 in the left-right direction, and a rotating shaft 161 is inserted through the hole. The rotating shaft 161 is provided in the front end of the connecting rod 160, which transmits the driving force to the thread wiper mechanism 70. By rotating, the sector gear 130 moves the projecting portion 133 and thus operates the connecting rod 160.

The guide hole 134 is formed in the plate face of the sector gear 130 in an area that is above the support shaft 117 when the sector gear 130 is in the origin point position. The guide hole 134 is an opening that is formed in a circular arc that is centered on the support shaft 117, and the guide hole 134 extends through the sector gear 130 in the width direction of the sector gear 130. The support shaft 118 of the first link rod 140 is inserted through the guide hole 134. The guide hole 134 is formed with a length such that, within the range of rotation of the sector gear 130, the support shaft 118 does not come into contact with the guide hole 134.

Figure 10:
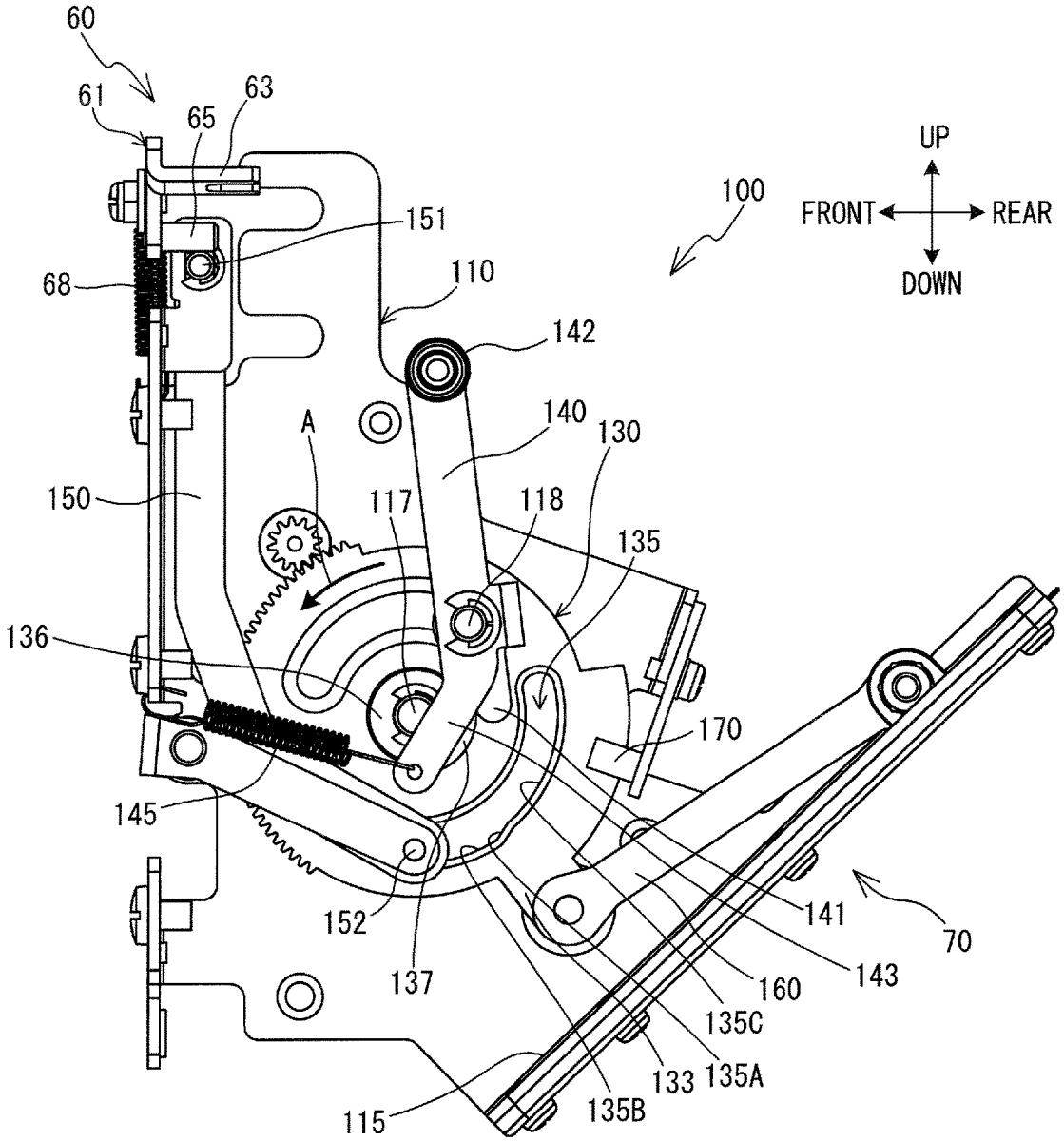
FIG. 10 is a right side view of the switching mechanism, the thread wiper mechanism, and the drive unit when the needle bar release mechanism is operating.

The grooved cam 135 is formed in the plate face of the sector gear 130 in an area that is below the support shaft 117 when the sector gear 130 is in the origin point position. The grooved cam 135 is a groove portion that is formed in a circular arc that is centered on the support shaft 117. A cam follower 152 is formed in the lower end of the second link rod 150, and the left end portion of the cam follower 152 engages with the grooved cam 135. The cam follower 152 is in contact with the outer circumferential wall of the grooved cam 135 through the entire range of rotation of the sector gear 130. As shown in FIG. 10, the outer circumferential wall of the grooved cam 135 includes a first outer circumferential wall portion 135B, a second outer circumferential wall portion 135C, and a step portion 135A. The step portion 135A is formed between the first outer circumferential wall portion 135B and the second outer circumferential wall portion 135C. When the sector gear 130 is in the origin point position, then in a right side view, the step portion 135A is positioned below the support shaft 117, the first outer circumferential wall portion 135B is positioned toward the front from the step portion 135A, and the second outer circumferential wall portion 135C is positioned toward the rear from the step portion 135A. The first outer circumferential wall portion 135B and the second outer circumferential wall portion 135C are each formed in a circular arc that is centered on the support shaft 117. The radius of the first outer circumferential wall portion 135B is greater than the radius of the second outer circumferential wall portion 135C. When the sector gear 130 rotates, the grooved cam 135 moves the cam follower 152 upward at the step portion 135A and the second outer circumferential wall portion 135C, and thus operates the second link rod 150.

As shown in FIG. 7, the disc cam 136 is formed on the front face of the sector gear 130 in a disc shape that is centered on the support shaft 117 and is provided as a single unit with the sector gear 130. The disc cam 136 includes an operating portion 137 that projects radially outward in the portion of the disc cam 136 that is below the support shaft 117 when the sector gear 130 is in the origin point position. A cam-driven portion 141 of the first link rod 140 comes into contact with the outer circumferential portion of the disc cam 136. When the sector gear 130 rotates, the operating portion 137 of the disc cam 136 moves the cam-driven portion 141 and thus operates the first link rod 140.

The first link rod 140 is a rod-shaped plate body that extends in the up-down direction and is disposed such that the thickness of the first link rod 140 extends in the left-right direction. The first link rod 140 is rotatably supported by the support shaft 118 at a position below the center of the first link rod 140 in the up-down direction. The portion of the first link rod 140 that is above the support shaft 118 extends straight upward from the position of the support shaft 118. The first pin 142, which transmits the driving force to the needle bar release mechanism 50, is provided at the upper end of the first link rod 140. The first pin 142 projects to the right from the first link rod 140. The first pin 142 is disposed higher than the sector gear 130 and is disposed on the rear side of the contact post 54 of the needle bar release mechanism 50.

The cam-driven portion 141 and an energized portion 143 are provided in the part of the first link rod 140 that is below the support shaft 118. The cam-driven portion 141 extends downward from the position of the support shaft 118. The lower end of the cam-driven portion 141 is disposed on the rear side of the support shaft 117 and comes into contact with the disc cam 136. The energized portion 143 extends obliquely downward toward the front from a position below the support shaft 118. A fastening hole 144 is formed in the lower end of the energized portion 143. One end of a tension spring 145 is fastened to the fastening hole 144. The other end of the tension spring 145 is fastened to a fastening hole 112B that is formed in the lower edge of the front face frame 112 of the gear frame 110. The tension spring 145 energizes the lower end of the energized portion 143 toward the front. Therefore, the first pin 142 of the first link rod 140 is energized toward the rear by the tension spring 145, with the support shaft 118 serving as a pivot point. The first pin 142 is kept in a state of contact with the contact post 54 of the needle bar release mechanism 50 (refer to FIG. 5). When the sector gear 130 rotates, and the operating portion 137 of the disc cam 136 presses the cam-driven portion 141 toward the rear, the first pin 142 moves toward the front and presses against the contact post 54, thus operating the needle bar release mechanism 50.

The second link rod 150 is a rod-shaped plate body that extends in the up-down direction and is disposed such that the thickness of the second link rod 150 extends in the left-right direction. The portion of the second link rod 150 that is above the center of the second link rod 150 in the up-down direction extends straight up and down. The second pin 151, which transmits the driving force to the switching mechanism 60, is provided at the upper end of the second link rod 150. The second pin 151 projects from the right side of the second link rod 150, is inserted from the left to the right through the support hole 116A that is formed in the pin guide portion 116 of the gear frame 110, and is held in place by a retaining ring. The second pin 151 is disposed below the operation pin 65 of the switching mechanism 60.

The portion of the second link rod 150 that is below the center of the second link rod 150 in the up-down direction bends toward the rear. The cam follower 152 is provided at the lower end of the second link rod 150. The cam follower 152 is a circular cylindrical rod member that extends in the left-right direction and is formed such that the outside diameter of the central portion of the cam follower 152 is larger than the outside diameters of the left and right ends. The right end portion of the cam follower 152 is affixed to the rear end portion of the support rod 155, the front end portion of which is supported by the support shaft 119. The support rod 155 is a rod-shaped plate body that extends in the front-rear direction and is disposed such that the thickness of the support rod 155 extends in the left-right direction. The second link rod 150 is disposed on the left side of the support rod 155. The central portion of the cam follower 152 is engaged with a hole (not shown in the drawings) that is formed in the lower end portion of the second link rod 150. The left end portion of the cam follower 152 is engaged with the grooved cam 135. The positioning of the rear end portion of the support rod 155 is determined in accordance with the range through which the support rod 155 can swing, with the support shaft 119 serving as a pivot point. Therefore, in the position that is below the support shaft 117 of the sector gear 130, the cam follower 152 comes into contact with one of the first outer circumferential wall portion 135B, the second outer circumferential wall portion 135C, and the step portion 135A of the grooved cam 135. When the sector gear 130 rotates, the cam follower 152 slides against the first outer circumferential wall portion 135B, the second outer circumferential wall portion 135C, and the step portion 135A of the grooved cam 135. As explained previously, the second outer circumferential wall portion 135C is formed in a circular arc that is centered on the support shaft 117, in a position where it is closer to the support shaft 117 in the radial direction than is the first outer circumferential wall portion 135B. In a case where the sector gear 130 rotates such that the cam follower 152 comes into contact with one of the second outer circumferential wall portion 135C and the step portion 135A, the cam follower 152 moves upward from where the cam follower 152 is in contact with the first outer circumferential wall portion 135B. When the second link rod 150 moves upward in conjunction with the upward movement of the cam follower 152, the second pin 151 presses the operation pin 65 upward and thus operates the switching mechanism 60.

The connecting rod 160 is a rod-shaped plate body that extends in the front-rear direction and is disposed such that the thickness of the connecting rod 160 extends in the left-right direction. The rotating shaft 161 is provided in the front end portion of the connecting rod 160. The rotating shaft 161 projects to the left from the connecting rod 160. The rotating shaft 161 is inserted through a hole (not shown in the drawings) that is formed in the projecting portion 133 of the sector gear 130 and is held in place on the left side of the projecting portion 133. The connecting rod 160 is supported by the rotating shaft 161 such that the connecting rod 160 is able to rotate in relation to the sector gear 130. A through-hole (not shown in the drawings) that extends in the width direction of connecting rod 160 is provided in the rear end portion of the connecting rod 160, and the shoulder screw 162 is inserted through the hole from the left side. The shoulder screw 162 is inserted through a hole (not shown in the drawings) that is provided in the support portion 73 of the thread wiper member 71, and is then tightened from the right side by a nut 163. The connecting rod 160 is supported by the shoulder screw 162 such that the connecting rod 160 is able to rotate in relation to the thread wiper member 71. When the sector gear 130 rotates, such that the projecting portion 133 rotates around the support shaft 117, the connecting rod 160 operates the thread wiper mechanism 70.

In a case where the sewing machine 1 with the configuration that is described above is used, the coupling member 33 of the needle bar 30 engages with the transmission member 51 of the needle bar release mechanism 50. That is, the sewing machine 1 is in a connected state, in which the transmission of the driving force of the sewing machine motor 16 between the drive shaft 17 and the needle bar 30 through the needle bar drive mechanism 40 is connected by the needle bar release mechanism 50. In the connected state, the sector gear 130 of the drive unit 100 is positioned at the origin point position (refer to FIG. 7), which is detected by the photo-sensor 170. That is, the needle bar release mechanism 50, the switching mechanism 60, and the thread wiper mechanism 70 are each in a non-operating state. In a case where the switching mechanism 60 is not operating, the contact member 61 is positioned in the first position. Therefore, even if the needle bar 30 moves up and down when the sewing machine 1 is performing sewing, the spacer 35 of the coupling member 33 does not come into contact with the contact portion 63.

The sewing machine 1 is able to change the upper threads 15 that are supplied from the plurality of the thread spools 13 that are mounted on the thread spool base 7 to the upper threads 15 that are suited to the sewing that the sewing machine 1 will perform. The sewing machine 1 includes a threading mechanism (not shown in the drawings) and is able to thread the upper thread 15 through the eye 9A of the sewing needle 9. In order to perform the threading operation, as well as the thread wiping operation for the upper thread 15, which is performed after the threading operation, the control portion (not shown in the drawings) of the sewing machine 1 positions the eye 9A in a state in which the transmission of driving force to the needle bar 30 is disconnected.

In a case where thread switching will be performed, the control portion first operates the needle bar release mechanism 50 to disconnect the transmission of the driving force of the sewing machine motor 16 to the needle bar 30. As shown in FIG. 10, the control portion applies a specified first pulse voltage to the pulse motor 120. As indicated by the arrow A, in a right side view, the sector gear 130 rotates counterclockwise from the origin point position by a first angle of rotation. The disc cam 136, which is provided as a single unit with the sector gear 130, also rotates counterclockwise by the first angle of rotation in a right side view. The operating portion 137, which is positioned below the support shaft 117 in the origin point position, moves to the rear of the support shaft 117 and presses the cam-driven portion 141 of the first link rod 140 toward the rear. In conjunction with the movement of the cam-driven portion 141 toward the rear, the first link rod 140 rotates counterclockwise around the support shaft 118 in a right side view, thus moving the first pin 142 toward the front.

Note that while the sector gear 130 rotates by the first angle of rotation, the cam follower 152 of the second link rod 150 slides along the first outer circumferential wall portion 135B of the grooved cam 135. Accordingly, the drive unit 100 does not move the second link rod 150 and does not operate the switching mechanism 60. That is, in a disconnection transition state, in which the transmission of the driving force between the drive shaft 17 and the needle bar 30 is in transition from the connected state to a disconnected state in which the transmission is disconnected, the switching mechanism 60 is in the non-operating state. Accordingly, the contact member 61 is positioned in the first position. In addition, the projecting portion 133 of the sector gear 130 moves toward the rear and, acting through the connecting rod 160, presses the thread wiper member 71 obliquely upward toward the rear. Accordingly, the drive unit 100 does not operate the thread wiper mechanism 70, so the hook 75 of the thread wiper member 71 is not positioned below the sewing needle 9.

As shown in FIG. 5, the first pin 142 presses the contact post 54 of the transmission member 51 of the needle bar release mechanism 50 toward the front. In a plan view, the transmission member 51 rotates counterclockwise around the needle bar base 41. The upper engagement lug 52 and the lower engagement lug 53 of the transmission member 51 move to positions that are in front of and obliquely to the right of the needle bar base 41, thus releasing the upper engagement lug 52 and the lower engagement lug 53 from their engagement with the coupling pin 34 of the needle bar 30. The needle bar 30 is released from its connection with the transmission member 51, moves upward as the needle bar 30 is energized by the compression spring (not shown in the drawings), and is positioned at the top dead point (refer to FIG. 2).

The control portion, by operating the pulse motor 120, rotates the sector gear 130 clockwise in a right side view and returns the sector gear 130 to the origin point position, as detected by the photo-sensor 170. The operating portion 137 of the disc cam 136 returns to a position below the support shaft 117 and stops pressing on the cam-driven portion 141. The energized portion 143 of the first link rod 140 is moved toward the front by the tension spring 145. The first link rod 140 rotates clockwise around the support shaft 118 in a right side view, thus returning the first pin 142 to a position above the support shaft 118. The transmission member 51 of the needle bar release mechanism 50 is rotated clockwise in a plan view by the coil spring 55. The upper engagement lug 52 and the lower engagement lug 53 move to positions in front of the needle bar base 41, that is, positions where the upper engagement lug 52 and the lower engagement lug 53 are able to engage with the coupling pin 34 of the needle bar 30. In a case where the needle bar 30 is in the disconnected state, the sector gear 130 is positioned at the origin point position, so the switching mechanism 60 is in the non-operating state. Accordingly, the contact member 61 is positioned in the first position.

Figure 11:
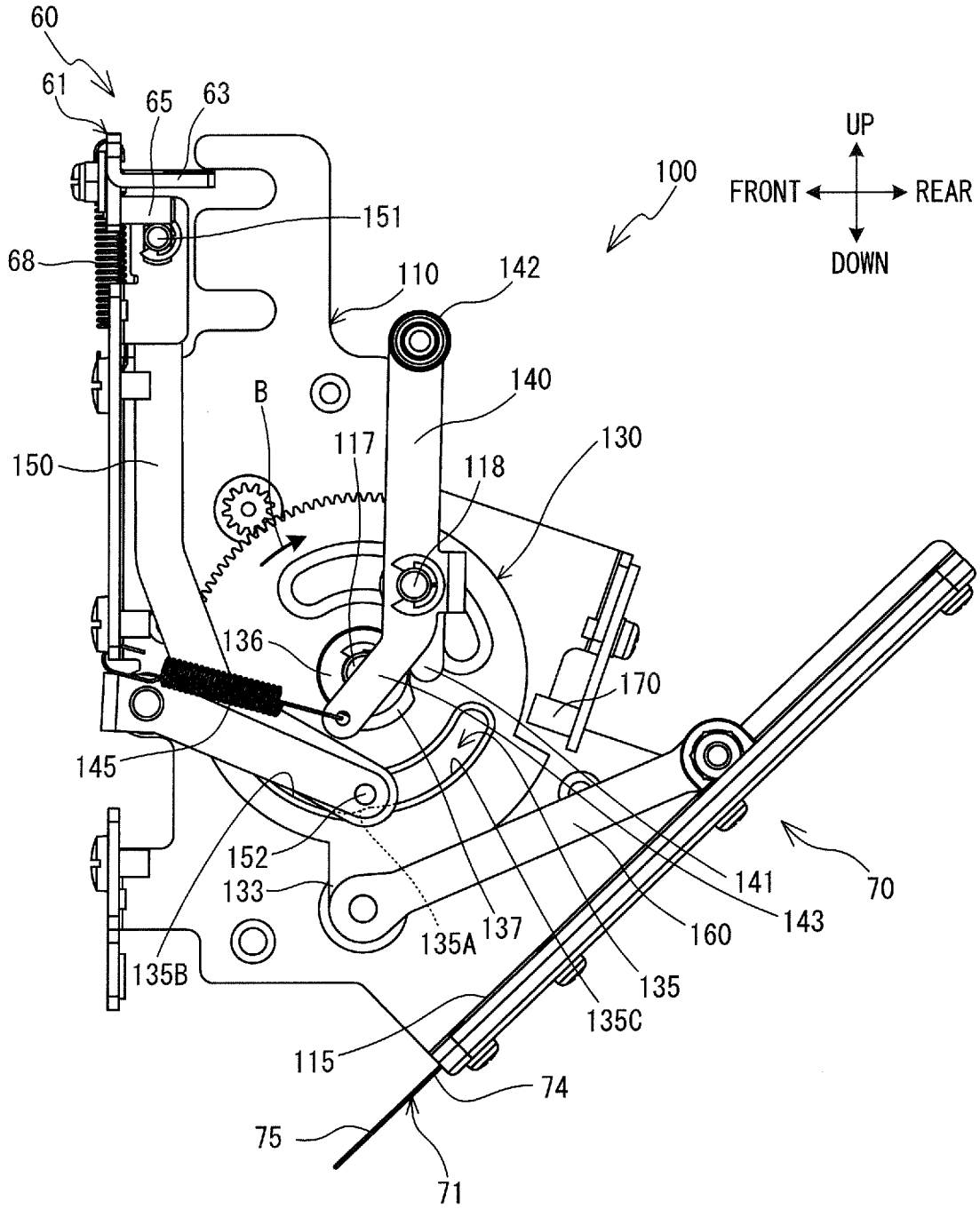
FIG. 11 is a right side view of the switching mechanism, the thread wiper mechanism, and the drive unit when the switching mechanism is operating.
Figure 12:
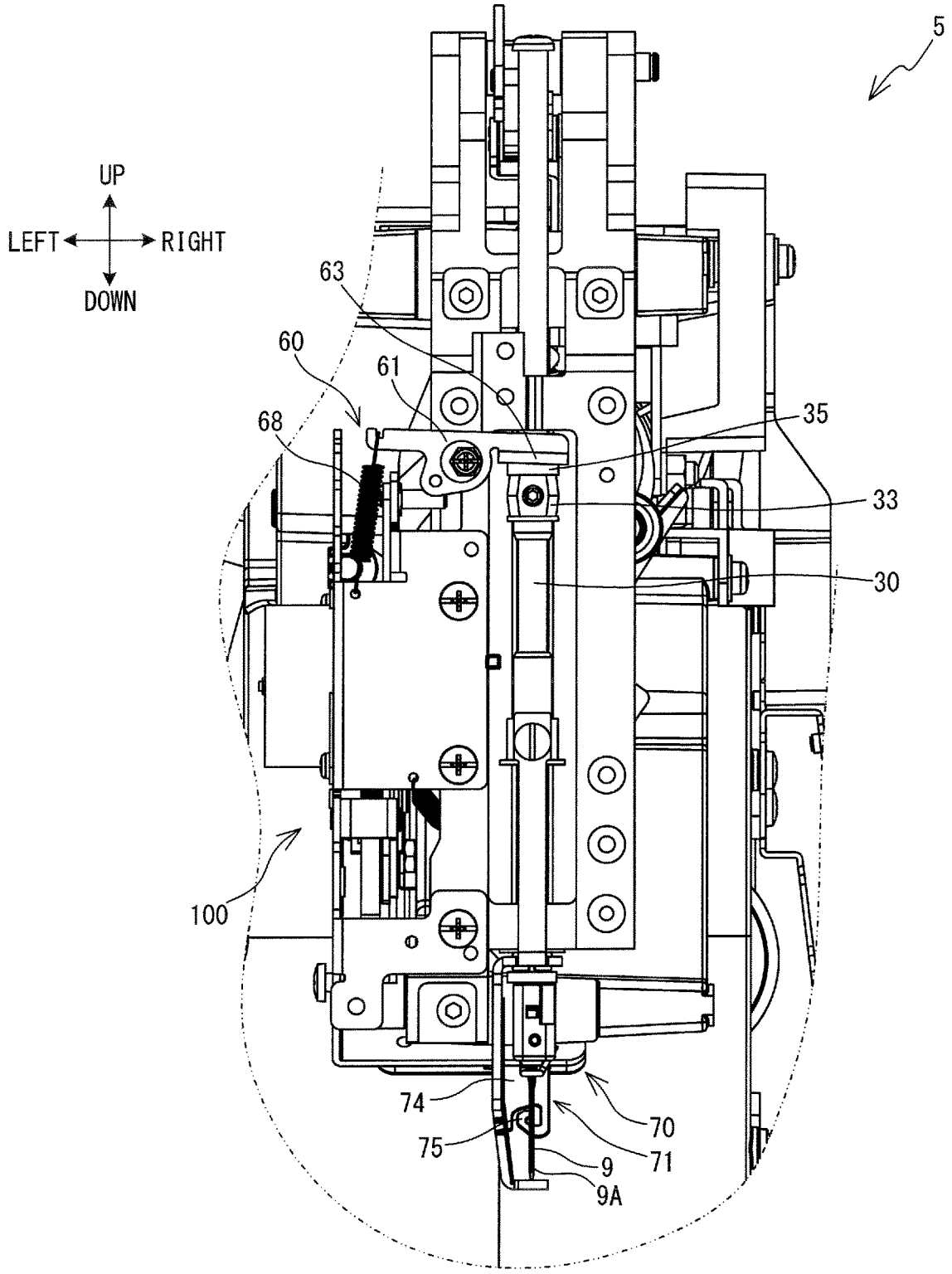
FIG. 12 is a figure that shows a portion of the configuration of the interior of the head when the switching mechanism is operating, as seen from the front of the sewing machine.

The threading operation, in which the threading mechanism (not shown in the drawings) threads the upper thread 15 through the eye 9A, and the thread wiping operation, in which the thread wiper mechanism 70 wipes the upper thread 15, are performed in a connection transition state, in which the transmission of the driving force to the needle bar 30 is in transition from the disconnected state to the connected state. In the connection transition state, in order to perform the threading operation, the control portion uses the contact member 61 to hold down the needle bar 30 and positions the eye 9A. As shown in FIG. 11, the control portion applies a specified second pulse voltage to the pulse motor 120. As indicated by the arrow B, in a right side view, the sector gear 130 rotates clockwise from the origin point position by a second angle of rotation. Sliding along the grooved cam 135 from the position where it is in contact with the first outer circumferential wall portion 135B, the cam follower 152 of the second link rod 150 slides over the step portion 135A and comes into contact with the second outer circumferential wall portion 135C. The cam follower 152 moves to a higher position than when the cam follower 152 was in contact with the first outer circumferential wall portion 135B. Accordingly, the second link rod 150 moves upward, causing the second pin 151 to press the operation pin 65 of the contact member 61 upward. As shown in FIG. 12, the contact member 61 is positioned in the second position. Energized by the compression spring, the contact portion 63 of the contact member 61 comes into contact with the spacer 35 of the coupling member 33 of the needle bar 30, which is positioned at the top dead point. The position of the needle bar 30 in the up-down direction is determined by its coming into contact with the contact member 61, as is the position of the eye 9A of the sewing needle 9, which is mounted on the lower end of the needle bar 30.

Note that while the sector gear 130 rotates by the second angle of rotation, the disc cam 136 also rotates clockwise in a right side view, as shown in FIG. 11. The operating portion 137 moves to a position in front of the support shaft 117, thus moving away from the cam-driven portion 141 of the first link rod 140. Accordingly, the drive unit 100 does not operate the first link rod 140 and thus does not operate the needle bar release mechanism 50. In addition, the projecting portion 133 of the sector gear 130 moves toward the front and, acting through the connecting rod 160, presses the thread wiper member 71 obliquely downward toward the front. The drive unit 100 thus moves the hook 75 of the thread wiper member 71 obliquely downward toward the front, but does not position it below the sewing needle 9. Accordingly, in the threading operation, the drive unit 100 does not operate the thread wiper mechanism 70.

Figure 13:
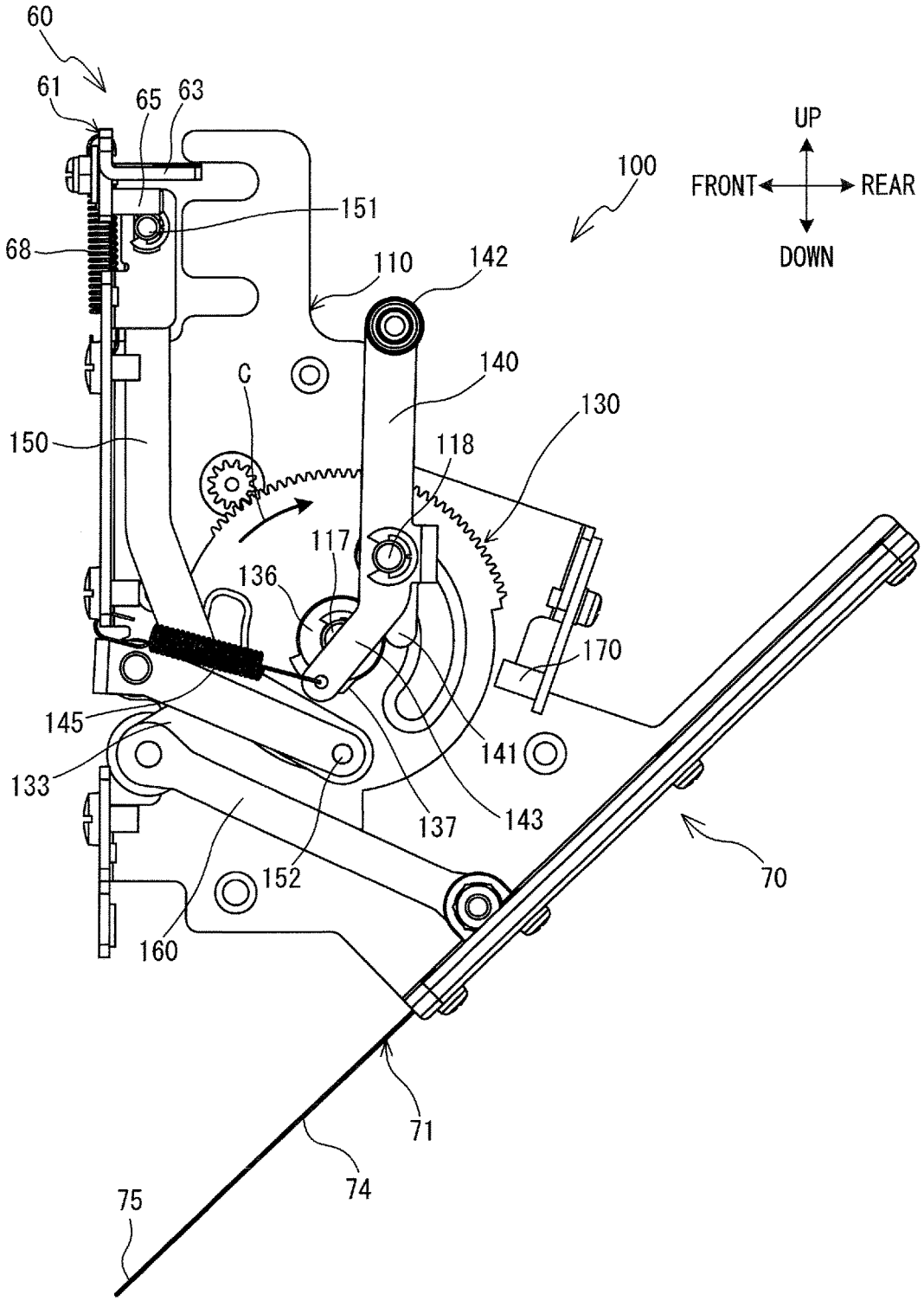
FIG. 13 is a right side view of the switching mechanism, the thread wiper mechanism, and the drive unit when the thread wiper mechanism is operating.
Figure 14:
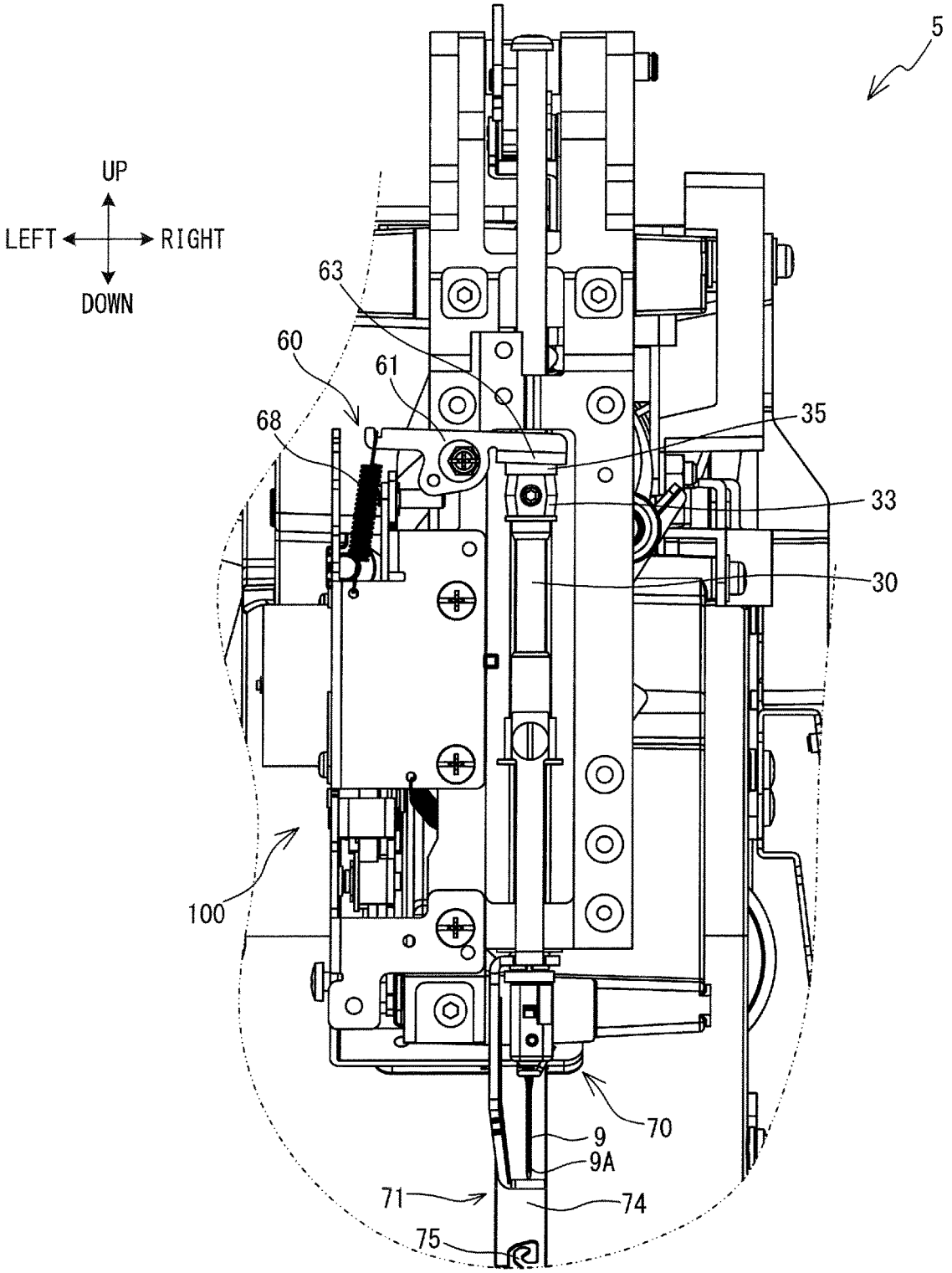
FIG. 14 is a figure that shows a portion of the configuration of the interior of the head when the thread wiper mechanism is operating, as seen from the front of the sewing machine.

The threading mechanism (not shown in the drawings) is operated, and the upper thread 15 is threaded through the eye 9A of the sewing needle 9, which has been positioned by the contact member 61. After the threading operation, the control portion performs the thread wiping operation. As shown in FIG. 13, the control portion applies a specified third pulse voltage to the pulse motor 120. As indicated by the arrow C, in a right side view, the sector gear 130 rotates farther clockwise, by a third angle of rotation, from the position to which the sector gear 130 had been rotated by the threading operation. The projecting portion 133 of the sector gear 130 moves farther toward the front and, acting through the connecting rod 160, presses the thread wiper member 71 obliquely downward toward the front. The drive unit 100 thus positions the hook 75 of the thread wiper member 71 below the sewing needle 9 and operates the thread wiper mechanism 70. The hook 75 passes through the eye 9A and holds the end portion of the upper thread 15, which is hanging downward from the sewing needle 9.

Note that while the sector gear 130 rotates by the third angle of rotation, the cam follower 152 of the second link rod 150 slides along the second outer circumferential wall portion 135C of the grooved cam 135. Accordingly, the second link rod 150 is kept in the state in which the second link rod 150 has moved upward. This keeps the operation pin 65 of the contact member 61 in the state in which the second link rod 150 is pressed upward by the second pin 151. Therefore, the contact member 61 is kept in the second position. Moreover, the needle bar 30 is kept in the state in which the needle bar 30 is positioned in contact with the contact member 61 by the energizing force of the compression spring. The disc cam 136 also rotates farther clockwise in a right side view. The operating portion 137 moves farther away from the cam-driven portion 141 of the first link rod 140. Accordingly, the drive unit 100 does not operate the first link rod 140 and thus does not operate the needle bar release mechanism 50.

The control portion, by operating the pulse motor 120, rotates the sector gear 130 counterclockwise in a right side view and returns the sector gear 130 to the origin point position, as detected by the photo-sensor 170. The projecting portion 133 of the sector gear 130 moves toward the rear and, acting through the connecting rod 160, moves the thread wiper member 71 obliquely upward toward the rear. The end portion of the upper thread 15, which is held by the hook 75, is wiped to the rear of the sewing needle 9 by the movement of the thread wiper member 71. The cam follower 152 of the second link rod 150 is returned to the state in which the cam follower 152 is in contact with the first outer circumferential wall portion 135B. Accordingly, the second link rod 150 moves downward, thus terminating the pressing of the operation pin 65 by the second pin 151. The disc cam 136 rotates in conjunction with the rotation of the sector gear 130, but the operating portion 137 does not come into contact with the cam-driven portion 141 of the first link rod 140.

The control portion, by operating the sewing machine motor 16, moves the drive member 42 of the needle bar drive mechanism 40 upward along the needle bar base 41. When the transmission member 51 of the needle bar release mechanism 50 is moved upward by the drive member 42, the upper engagement lug 52 comes into contact with the coupling pin 34 of the needle bar 30 from below. The coupling pin 34, by pressing against the top face of the upper engagement lug 52, which is formed as an inclined face, rotates the transmission member 51 counterclockwise in a plan view. When the transmission member 51 moves farther upward, and the upper engagement lug 52 is positioned higher than the coupling pin 34, the upper engagement lug 52 and the lower engagement lug 53 are moved by the coil spring 55 to a position in front of the needle bar base 41. The coupling pin 34 is held between the upper engagement lug 52 and the lower engagement lug 53, and the coupling member 33 of the needle bar 30 engages with the transmission member 51 of the needle bar release mechanism 50. In other words, the sewing machine 1 enters the connected state, in which the transmission of the driving force of the sewing machine motor 16 between the drive shaft 17 and the needle bar 30 is connected.

As explained above, in the connected state, the switching mechanism 60 is able to switch the position of the contact member 61 to the first position. When the contact member 61 is positioned in the first position, the needle bar 30 does not come into contact with the contact member 61, even if the driving force of the sewing machine motor 16 is transmitted to the needle bar 30 and the needle bar 30 moves reciprocally up and down. Therefore, the sewing machine 1 is able to prevent the occurrence of noise and vibration that are attributable to contact between the needle bar 30 and the contact member 61. Furthermore, in the connection transition state, the switching mechanism 60 is able to switch the position of the contact member 61 to the second position. Therefore, in the connection transition state, the sewing machine 1 is able to reliably set the position of the needle bar 30 in the up-down direction by bringing the needle bar 30 into contact with the contact member 61.

Furthermore, because the needle bar release mechanism 50 and the switching mechanism 60 can both be driven by the pulse motor 120, which is their common actuator, the number of parts of the sewing machine 1 can be decreased, and the production cost can be reduced. Moreover, because the needle bar release mechanism 50, the switching mechanism 60, and the thread wiper mechanism 70 can all be driven by the pulse motor 120, which is their common actuator, the number of parts of the sewing machine 1 can be decreased further, and the production cost can be reduced even more.

The driving force of the single pulse motor 120 can be transmitted to the needle bar release mechanism 50 by a cam mechanism that includes the disc cam 136 and the cam-driven portion 141, can be transmitted to the switching mechanism 60 by a cam mechanism that includes the grooved cam 135 and the cam follower 152, and can be transmitted to the thread wiper mechanism 70 by a crank mechanism that includes the projecting portion 133 and the connecting rod 160. Therefore, simply by operating the single pulse motor 120, the sewing machine 1 is able to operate the needle bar release mechanism 50, the switching mechanism 60, and the thread wiper mechanism 70 in a mechanically coordinated manner. Moreover, because the operations of the various mechanisms are mechanically coordinated, discrepancies in the timing of the operations do not readily occur.

Furthermore, by using the eccentric nut 67 to adjust the second position of the contact member 61, the sewing machine 1 is able to adjust appropriately the position where the needle bar 30 and the contact member 61 come into contact when the needle bar 30 is positioned at the top dead point. Therefore, the sewing machine 1 is able to position the needle bar 30 appropriately, even if there are irregularities in the dimensions of the structural members of the various mechanisms.

Various types of modifications can be made to the embodiment that is described above. The switching mechanism 60 is operated by the cam mechanism that is configured from the grooved cam 135 and the cam follower 152, but it may also be operated by a cam mechanism that is configured from a disc cam and a cam-driven portion, as well as by a crank mechanism that is configured from a connecting rod. In the same manner, the needle bar release mechanism 50 may also be operated by a cam mechanism that is configured from a grooved cam and a cam follower, as well as by the cam mechanism that is configured from the grooved cam 135 and the cam follower 152. Furthermore, the thread wiper mechanism 70 may also be operated by a cam mechanism that is configured from a grooved cam and a cam follower, as well as one that is configured from a disc cam and a cam-driven portion.

The second position of the contact member 61 is adjusted in the up-down direction by the eccentric nut 67, but it may also be adjusted by other means that can shift the position of the center of rotation of the contact member 61.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a needle bar configured to move up and down, a driving force of a sewing machine motor being transmitted through a drive shaft to the needle bar;

a needle bar release mechanism configured to connect and disconnect a transmission of the driving force between the drive shaft and the needle bar;

a drive portion configured to drive the needle bar release mechanism;

a contact member configured to come into contact with the needle bar in a case where the needle bar is positioned at a top dead point of a range within which the needle bar is able to move up and down; and a switching mechanism configured to switch a position of the contact member between a first position and a second position, the first position being a position in which the contact member does not come into contact with the needle bar in a case where the needle bar is positioned at the top dead point, and the second position being a position in which the contact member does come into contact with the needle bar in a case where the needle bar is positioned at the top dead point, the switching mechanism positioning the contact member in the first position when the sewing machine is in a connected state, the connected state being a state in which the transmission of the driving force between the drive shaft and the needle bar is connected, and the switching mechanism positioning the contact member in the second position when the sewing machine is in a connection transition state, the connection transition state being a state in which the sewing machine is in transition from a disconnected state to the connected state, the disconnected state being a state in which the transmission of the driving force between the drive shaft and the needle bar is disconnected.

2. The sewing machine according to claim 1, wherein the switching mechanism switches the position of the contact member to the first position when the sewing machine is in any one of the connected state, the disconnected state, and a disconnection transition state, the disconnection transition state being a state in which the sewing machine is in transition from the connected state to the disconnected state.

3. The sewing machine according to claim 1, wherein the drive portion is configured to drive the needle bar release mechanism and the switching mechanism.

4. The sewing machine according to claim 3, further comprising:

a thread wiper mechanism configured to wipe an upper thread extending downward through an eye of a sewing needle mounted on a lower end of the needle bar, wherein the drive portion is also configured to drive the thread wiper mechanism.

5. The sewing machine according to claim 4, wherein the drive portion includes an actuator, a rotating body that is substantially disc-shaped and is configured to be rotated by a driving force of the actuator, a disc cam formed on a plate face of the rotating body and projecting in a radial direction from the center of rotation of the rotating body, a first link rod, on one end of the first link rod being provided a cam-driven portion, the cam-driven portion being configured to be moved by pressure from the disc cam, on the other end of the first link rod being provided a first pin, the first pin being configured to transmit the driving force of the actuator to the needle bar release mechanism, a grooved cam formed in the plate face of the rotating body, a second link rod, on one end of the second link rod being provided a cam follower, the cam follower being configured to follow the grooved cam, on the other end of the second link rod being provided a second pin, the second pin being configured to transmit the driving force of the actuator to the switching mechanism, and a coupling rod, one end of the coupling rod being configured to be supported by an outer circumferential portion of the rotating body such that the coupling rod can pivot, the other end of the coupling rod being connected to the thread wiper mechanism and being configured to transmit the driving force of the actuator to the thread wiper mechanism.

6. The sewing machine according to claim 3, wherein the switching mechanism is provided with an energizing member, the energizing member being configured to energize the contact member, the contact member includes a contact portion provided on one end of the contact member and configured to come into contact with the needle bar, an energized portion provided on the other end of the contact member and configured to be energized by the energizing member, a center of rotation portion provided between the contact portion and the energized portion, and a driven portion configured to receive a driving force of the drive portion, the switching mechanism switches the position of the contact member to the first position by rotating the contact member around the center of rotation portion by a driving force of the energizing member that energizes the energized portion, and the switching mechanism switches the position of the contact member to the second position by rotating the contact member around the center of rotation portion by causing the driven portion to receive the driving force of the drive portion, which acts in the opposite direction from the direction in which the energizing member energizes the energized portion.

7. The sewing machine according to claim 1, further comprising:

an adjustment portion configured to adjust the second position of the contact member in the up-down direction.

8. A sewing machine, comprising:

a motor configured to generate a driving force;

a needle bar configured to move up and down by the driving force of the motor;

a needle bar release mechanism configured to connect and disconnect a transmission of the driving force of the motor to the needle bar; and a contact member configured to move between a first position and a second position, the first position being a position in which the contact member does not come into contact with the needle bar in a case where the needle bar is positioned at a top dead point of a range within which the needle bar is able to move up and down when the sewing machine is in a connected state, the connected state being a state in which the needle bar release mechanism connects the transmission of the driving force of the motor to the needle bar, and the second position being a position in which the contact member does come into contact with the needle bar in a case where the needle bar is positioned at the top dead point when the sewing machine is in a connection transition state, the connection transition state being a state in which the sewing machine is in transition from a disconnected state to the connected state, the disconnected state being a state in which the needle bar release mechanism disconnects the transmission of the driving force of the motor to the needle bar.

* * * * *